US008176696B2

(12) United States Patent
LeBlang

(10) Patent No.: US 8,176,696 B2
(45) Date of Patent: May 15, 2012

(54) BUILDING CONSTRUCTION FOR FORMING COLUMNS AND BEAMS WITHIN A WALL MOLD

(76) Inventor: Dennis William LeBlang, Indio, CA (US)

( * ) Notice: Subject to any disclaimer, the term of this patent is extended or adjusted under 35 U.S.C. 154(b) by 269 days.

(21) Appl. No.: 12/231,875

(22) Filed: Sep. 8, 2008

(65) Prior Publication Data

US 2009/0107065 A1 Apr. 30, 2009

Related U.S. Application Data

(60) Provisional application No. 61/000,112, filed on Oct. 24, 2007, provisional application No. 61/137,224, filed on Jul. 29, 2008.

(51) Int. Cl.
*E04C 1/42* (2006.01)

(52) U.S. Cl. ..... 52/309.12; 52/252; 52/309.4

(58) Field of Classification Search ..... 52/252, 52/309.12, 309.4
See application file for complete search history.

(56) References Cited

U.S. PATENT DOCUMENTS

| | | | | |
|---|---|---|---|---|
| 3,678,638 | A | | 7/1972 | Mougin |
| 4,338,759 | A | | 7/1982 | Shubow |
| 4,357,783 | A | | 11/1982 | Shubow |
| 4,602,467 | A | | 7/1986 | Schilger |
| 4,774,794 | A | | 10/1988 | Grieb |
| 4,909,007 | A | | 3/1990 | Bodnar |
| 4,930,278 | A | | 6/1990 | Staresina |
| 5,138,813 | A | | 8/1992 | Cooney |
| 5,207,045 | A | | 5/1993 | Bodnar |
| 5,279,091 | A | | 1/1994 | Williams |
| 5,335,472 | A | | 8/1994 | Phillips |
| 5,365,716 | A | | 11/1994 | Munson |
| 5,497,589 | A | | 3/1996 | Porter |
| 5,526,629 | A | | 6/1996 | Cavaness |
| 5,566,518 | A | | 10/1996 | Martin |
| 5,628,158 | A | | 5/1997 | Porter |
| 5,655,350 | A | | 8/1997 | Patton |
| 5,722,198 | A | * | 3/1998 | Bader ..... 52/745.09 |
| 5,758,463 | A | | 6/1998 | Mancini |
| 5,809,724 | A | | 9/1998 | Bodnar |
| 5,809,726 | A | | 9/1998 | Spude |
| 5,819,496 | A | | 10/1998 | Sperber |
| 5,839,249 | A | | 11/1998 | Roberts |
| 5,842,314 | A | | 12/1998 | Porter |
| 5,943,775 | A | | 8/1999 | Lanham |
| 5,950,389 | A | | 9/1999 | Porter |
| 5,992,114 | A | | 11/1999 | Zelinsky |
| 6,026,620 | A | | 2/2000 | Spude |
| 6,041,561 | A | | 3/2000 | LeBlang |
| 6,041,562 | A | | 3/2000 | Martella |
| 6,119,432 | A | | 9/2000 | Niemann |
| 6,122,888 | A | | 9/2000 | Bodnar |

(Continued)

*Primary Examiner* — Jeanette E Chapman
*Assistant Examiner* — Daniel Kenny

(57) ABSTRACT

The present invention relates to an improved wall system where a wall form mold has a structural insulated core assembled to form a structural insulated panel (SIP) to form a concrete beam and concrete column to be poured anywhere within the wall as well as between building modules when placed together and erected vertically. The interlocking wall molds interlock within the wall as well as between panels and modules. The wall panels allow concrete columns and beams to be formed in any size and shape. The structural insulated core consists of interlocking foam spacers and support channels which can be glued or screwed together to form an independent wall or as part of a precast wall with columns and beams integrated within the wall panels. Insulated flanges within the wall forming mold separates the wall forming structure from the wall surfaces.

5 Claims, 22 Drawing Sheets

U.S. PATENT DOCUMENTS 6,125,608 A 10/2000 Charlson
6,131,365 A 10/2000 Crockett
6,134,861 A 10/2000 Spude
6,151,858 A 11/2000 Ruiz
6,164,035 A 12/2000 Roberts
6,167,624 B1 1/2001 Lanham
6,247,280 B1 6/2001 Grinshpun
6,250,033 B1 6/2001 Zelinsky
6,256,960 B1 7/2001 Babcock
6,263,628 B1 * 7/2001 Griffin ..... 52/309.12
6,269,608 B1 8/2001 Porter
6,293,067 B1 9/2001 Meendering
6,308,491 B1 10/2001 Porter
6,355,193 B1 3/2002 Stott
6,378,260 B1 4/2002 Williamson
6,401,417 B1 6/2002 LeBlang
6,408,594 B1 6/2002 Porter
6,438,918 B2 8/2002 Moore
6,481,178 B2 11/2002 Moore
6,519,904 B1 2/2003 Phillips
6,523,312 B2 2/2003 Budge
6,541,097 B2 4/2003 Lynch
6,564,521 B1 5/2003 Brown
6,568,138 B1 5/2003 Frost
6,584,742 B1 7/2003 Kilier
6,588,168 B2 7/2003 Walters
6,609,340 B2 8/2003 Moore
6,647,686 B2 11/2003 Dunn
6,662,516 B2 12/2003 Vandehey
6,681,539 B2 1/2004 Yost
6,698,710 B1 3/2004 VanderWerf
6,708,459 B2 3/2004 Bodnar
6,729,094 B1 5/2004 Spencer
6,754,995 B1 6/2004 Davis
6,817,151 B2 11/2004 Foderberg
6,837,013 B2 1/2005 Foderberg
6,851,235 B2 2/2005 Baldwin
6,869,669 B2 3/2005 Jensen
6,880,304 B1 4/2005 Budge
6,935,081 B2 8/2005 Dunn
6,988,347 B2 1/2006 Nanayakkara
7,028,439 B2 4/2006 Foderberg
7,028,440 B2 4/2006 Brisson
7,077,988 B2 7/2006 Gosselin
7,185,467 B2 3/2007 Marty
7,231,746 B2 6/2007 Bodnar
7,232,605 B2 6/2007 Burgueno
7,254,925 B2 * 8/2007 Stefanutti et al. ..... 52/309.9
7,278,244 B1 10/2007 Rubio
7,308,778 B2 12/2007 Nanayakkara
7,395,999 B2 7/2008 Walpole
7,409,800 B2 8/2008 Budge
2001/0027630 A1 10/2001 Moore
2006/0251851 A1 11/2006 Bowman
2007/0044392 A1 3/2007 LeBlang
2007/0062134 A1 3/2007 Chung
2007/0199266 A1 8/2007 Geilen
2007/0278381 A1 12/2007 Marker
2008/0066408 A1 3/2008 Hileman

* cited by examiner

BUILDING CONSTRUCTION FOR FORMING COLUMNS AND BEAMS WITHIN A WALL MOLD

REFERENCE TO RELATED APPLICATIONS

A provisional patent application No. 61/000,112 was filed on Oct. 24, 2007, plus provisional application No. 61/137,224 was filed on Jul. 29, 2008.

BACKGROUND OF THE INVENTION (1) Field of the Invention

The present invention relates to an improved wall system where a wall form mold has a structural insulating core assembled to form a structural insulated panel (SIP) to form a concrete beam and concrete column to be poured within the wall. In addition, the wall forming structure of the wall mold penetrates into the foundation and into the wall form mold above allowing the concrete column and beam to penetrate into the adjacent form molds. The wall molds can be used to form modular buildings units and can be used to create larger columns and beams when two modular building units are placed adjacent to each other. Insulated flanges of the wall forming mold separates the wall forming structure from the wall surfaces and can also be used as a precast form support. The structural insulating core can also be used as an independent framed wall, as well as a precast forming mold either poured face up or face down. Different types of insulation and methods of installation are discussed and therefore more prior art is discussed as well as a more in depth discussion on the background of the invention is mentioned.

BACKGROUND OF THE INVENTION

There are several methods to support multiple floors or a roof structure of a building, that is, by using a load bearing wall or by using a beam which is supported by posts on both sides of the beam. Should a wall require any windows a beam is installed above the window and columns are installed on both sides of the window. A high-rise or larger type buildings, uses columns and beams to support the additional floors and roof loads above. On the other hand, smaller buildings also use walls to support the weight of additional floors or roof load above. These load bearing walls can be made of solid masonry, concrete or even as a framed wall using wood or metal framing members typically spaced 16-24 inches apart. A non-load bearing wall can also be made using wood or metal framing members, the wall only supports itself not a roof or floor load above. The non-load bearing wall can also be built the same way, however the structural capacity of the framing members are less and therefore the material costs are less expensive.

The construction of a wall varies based on the type of materials that are used. For example a solid concrete or masonry wall does not need to be laterally supported, because the wall is connected horizontally from say one masonry block to another masonry block. On the other hand, a post and beam type construction needs to be horizontally braced somewhere within that building otherwise the building would collapse if the wind or an earthquake would cause the building to move horizontally. Usually that is done by adding diagonal braces that criss-cross between the columns or by adding a solid wall somewhere within the building structure. When a smaller wood or metal framed wall has a similar problem, that is, the framing members need to be supported between each other using by applying plywood over the framing members.

The plywood acts a shear wall, by not allowing the framing members to fall down like "domino's".

Typically the higher the wall, the thicker the wall becomes. This occurs because if a tall wall is not laterally supported (braced by another structure) then the wall will bend. For example, a masonry wall can have a pilaster added, that is, a column attached to the wall and made of the same material.

Another way to stop a wall from bending is adding a lateral support; that could be in the form of adding a horizontal stud in the middle of a wood wall or a horizontal channel in the middle of a steel wall also known as a purlin. With wood or metal framing members require fire stops (a horizontal framing member between vertical framing members) at walls over eight feet and between one floor and another floor at the floor line. When a wall is required to be taller than what is required by building codes, the wall width or the wood studs or metal channels are required to be wider to accommodate the increase wall height. In addition the higher the wall, the more need there is to have intermediate horizontal bracing members. For wood construction, these usually are accomplished by adding horizontal wood studs between the vertical studs. For metal construction this is accomplished by adding a lateral channels that pass through the holes between each of the C channels. In tubular metal construction, two opposite sides of the tube are removed and the remaining two sides are attached to the vertical tubular metal supports. In heavy steel construction, known as red iron, horizontal purlins are installed between the vertical steel supports. In all the various constructions, the horizontal lateral supports reduce the amount of bending caused by horizontal wind loads as well as the vertical load of which there are designed to support like roof or floor loads from above.

When constructing a single or multiple floors between the ground level and the roof, a fire stop is required between floors. This is accomplished by installing a solid horizontal plate break in the wall construction separating the wall construction between one occupied floor and another floor. Typically, this fire stop occurs when the end of the floor joist rests upon the wall. In wood construction it is usually using two wood plates. One plate is attached to each stud and another plate is installed over the lower plate to overlap the individual wall sections together. The floor joists are then installed over the top plate and a ledger board is installed perpendicular to the floor joists thereby connecting each joist. Wood decking is installed over the floor joists and then individual wall sections are installed over the floor decking. Metal light gauge framing is also built in the same way, however only one base plate is used at the top and bottom of the metal channels. The metal floor joists are both secured to the top wall base plate as well as the ledger channel at the end of the floor joists. For post and beam construction, for either heavy structural steel or concrete, a beam is used to support the floor load between columns and a fire stop is required when the exterior finish material does not stop between floors.

Typically wood or metal framed wall construction must be secured to a foundation or concrete slab either by anchor bolts embedded within a concrete wall and or attaching tie down supports which are secured to the metal or wood studs and then anchored into the foundation or foundation.

Concrete construction has changed over the years since the days of the Roman Empire where concrete was initially used. From the early concrete building structures, concrete wall construction has developed into today's construction uses ICF's (insulated concrete forms) to build concrete walls. Now as energy has become more expensive, these ICF's have reduced the amount of concrete within the wall by adding more insulation thereby creating columns and beams within the ICF's. These ICF's have a very rigid system with no flexibility on where to install the beams or columns.

Structural insulated panels or SIP's have a foam core with exterior skins usually plywood glued to the foam. Sometimes metal or wood is installed within the foam core and the wood or metal is connected between the panels for additional support. SIP's have a very limited load bearing capacity due to the structural limitation in the design of the panels. The use of SIP's have been limited to one or two story building and have never been used in conjunction with precast or poured-in-place concrete walls.

Rigid insulation boards have been installed on metal channels for years and more recently rigid insulation has been glued onto metal channels as a thermal barrier. Insulating blocks have embedded channels within insulation blocks also embedding the metal channels within the rigid insulation. Some insulated concrete forms (ICF's) have embedded plastic connectors within their rigid insulation blocks also separating the rigid foam from the plastic connectors. Structural insulated panels (SIP's) have no thermal break when wood or metal is added at the connections of adjacent panels. None of the systems has a interior and sheathing insulation combined as well as creating a thermal break within a wall forming structure.

Thin faced precast concrete wall panels have been using light gauge metal framing for the structural backing for a few years now. When the concrete is poured face up, insulation supports the concrete until it has cured, while pouring the concrete face down in a forming bed, the light gauge metal framing is suspended over the forming bed and the metal channel is typically embedded into the concrete facing and usually no thermal break is accomplished. These systems do not combine the wall and sheathing insulation, plus have that thermal break as well as the flexibility to install columns and beams within the structure.

Thin cementitious material has been applied over foam, however usually to make a block, and the entire block is entirely encased with the cementitious material. Sometimes a wall panel has also been fully encased with the cementitious material and recently an ICF block has been partially encased with the cementitious material. Cementitious materials have not applied to wall panels where the cementitious materials have had the thermal break between the interior and exterior surfaces.

Modular buildings have been very limited in their design and functionality of their superstructure. Modular construction has been typically limited to wood framed building and some have been developed using steel as a column and beam substructure. Concrete has had limited exposure in modular buildings, as well as the use of a insulated core to form concrete beams and columns within the exterior walls and common walls between modular buildings.

Today, more and more steel or concrete post and beam buildings are being built. Construction techniques for building walls have been changing significantly including metal channel framing and stay-in-place insulated forms where concrete is installed within these forms.

DESCRIPTION OF PRIOR ART

There have been various attempts on creating a form mold to pour a concrete column or beam within a wall. Some patents uses metal channels to help reduce the pressure produced by using a rigid foam material to form concrete beam or columns. Another type of patents uses foam blocks with vertical and horizontal chambers to form concrete columns and beams. Another type of panel is a composite panel that uses fiber concrete boards the panel surfaces as well as interior bracing within the panel with rigid foam at the interior. Another type of panel is when the foam molds create a continuous chamber to pour a solid concrete wall.

Various types of material are used in different capacity that can vary the way panels are made and formed. A triangular channel is used in wall panels, however their configuration, use and function is totally different. A rigid insulation is installed within the flanges of the rigid support structure, isolating the support from the concrete as well as allowing for additional fasteners to be installed later. Rigid and/or loose foam insulation is used in construction; however the insulation is not used in the same method to build a wall. Insulated concrete forms have been used in construction; however some types of ICF (Insulated Concrete Forms) are not capable of installing concrete columns or beams within the ICF walls as they were only intended to be used as full width concrete walls and other ICF's have no flexibility in column spacing. Structural insulated panels (SIP's) with their foam core and plywood exterior have a very limited use. Thin cast precast walls poured both face up or face down into a light gauged metal framed wall have typically no thermal break with the metal channel framing and the thin precast concrete wall facing. Another product is a corrugated fiberboard that can form a panel in a totally different way.

A. Concrete Column & Beam Using Metal Channels

Panels are formed here using rigid boards and or rigid insulation along with metal channels to form concrete columns or beams. The light gauge framing adds support means for installing drywall or other surface building materials.

In U.S. Pat. No. 6,041,561 & U.S. Pat. No. 6,401,417 by LeBlang shows how a concrete column and beam can be installed within a wall using metal channels and rigid insulation/hard board or as a column and beam within a wall and or as a separate beam using a rigid board between the channels to enlarge the beams or columns.

In U.S. Pat. No. 6,256,960 by Babcock (filed Apr. 12, 1999) is a modular SIP wall panel with a metal channel at one edge and overlapping inner and outer skins attached to the metal channel. One metal channel and the interior foam wall core form a pocket into which concrete can be poured to form a concrete column. A metal plate covers the top of the SIP panel for connection to a roof structure. The concrete columns are only one channel wide and therefore the column size or structural capacity is very limited.

In US 2007/0044392 by LeBlang shows a beam at the top of bottom of a wall connecting columns as well as a continuous narrow concrete wall. Another item in this application is when the vertical C channels extends into the footing prior to concrete installed within the wall. In addition an H channel is used to connect the outside surfaces of the forming mold into which concrete is then installed.

B. Foam Block With Holes.

The next several existing patents uses tubes or rigid foam with vertical holes to form a concrete columns. If light gauge steel is used, the metal is on the exterior of the form and not permanently attached to the foam.

In U.S. Pat. No. 4,338,759 by Swerdow (filed Jul. 28, 1980) and U.S. Pat. No. 4,357,783 by Shubow use a plurality of spaced, thin walled tubes are placed between two rows of channels into which concrete is then poured into the walled tubes to make an array of concrete columns within a wall. A beam is installed between the two rows of channels and is support by a metal channel with holes for the columns. The double wall construction is expensive solution to form a concrete column and a method to support the sides of the beam on top of the wall.

In U.S. Pat. No. 5,839,249 by Roberts (filed Nov. 16, 1996) & U.S. Pat. No. 6,164,035 by Roberts (filed Nov. 23, 1998) uses a foam block with vertical holes in it which is large enough to insert a metal vertical support as well as pour a vertical concrete column after the wall has been erected. A U shaped foam block sets on top of the wall and has holes which connect to the concrete columns. Also electrical outlets are shown where the foam has been removed and conduits are installed in the wall. In U.S. Pat. No. 6,588,168 (filed Apr. 17, 2001) by Walters also uses the U shaped foam block for construction a beam on top of a foam wall. The vertical foam void shows a metal channel in one hole and a vertically poured concrete column in other holes. The vertical holes are uniform in size and therefore fixing the size of the concrete columns. Since the concrete beam is a mold, the size is also limited to change without ordering different molds for different size beams.

Another type of foam panel is U.S. Pat. No. 6,523,312 by Budge (filed Feb. 25, 2003) that uses a foam panel with an array of vertically large holes as the mold chamber for a concrete column and a hollow section on top to form a concrete beam. The foam is embedded into a concrete footing to stabilize the wall prior to pouring concrete. The wall panel uses interlocking foam to secure one panel to another and no light gauge framing is used to support the panel.

In U.S. Pat. No. 6,131,365 (filed Oct. 2, 1998) by Crockett has a wall unit system consisting of interior foam ridges at the interior and a foam board on the exterior. A steel base plate is installed and the bottom and a hold-down hook at the top of panel with vertical straight plates between panels. A "tie down space" is in the middle of the wall for installing steel reinforcing to create a concrete column and a horizontal concrete beam is installed at the top of the wall. The insulated structural material in the middle of the wall is foamed plastic, foamed concrete etc. Nothing is shown or mentioned on how to hold the wall together when filling the wall with insulated structural material. The interior concrete column and beam does not show any prior art plus the interior insulated structural material also does not pertain to the pending patent.

In U.S. Pat. No. 6,119,432 (filed Sep. 3, 1999) by Niemann forms a panel by cutting the polystyrene foam into a concrete beam on top and bottom of panel. In addition the foam is cut into a rib pattern then glued back to create vertical holes within the foam into which concrete is then poured into the columns and beams. The patent does disclose recessed furring strips on the exterior of the wall. The patent discloses glue as the only means of holding the two sides of the panel together. The pressure of the wet concrete will push the two sides apart and the furring channel will probably be required to hold the panel together. The ribbed foam panels limits the size, spacing and structural integrity of the concrete beams as well as the array of concrete columns.

In U.S. Pat. No. 7,028,440 (filed Nov. 29, 2003) by Brisson uses foam blocks with vertical holes to form concrete columns and uses a horizontal recess at the top of the panels to form a beam pocket. The foam panels are made using a tongue and groove type connections between panels and the panels are glued together. Since the holes for the concrete are only support by foam, the size is limited as the concrete will deform as well as break the foam panels. Again the beam pocket is also fragile as there is not support to stop the wet concrete from deforming the beam.

In US 2007/0199266 (filed Feb. 27, 2006) by Geilen is a foam block with a hole at the interior for a concrete column and a foam cavity for a beam. At the exterior of the panel, vertical recessed wood or metal furring strips are installed at the column cavities of the panel and function as a wall forming structure. The interior portion of the foam panel is a tongue and groove construction interlocking adjacent panels together. A horizontal void in the interior foam forms a beam pocket at the top of the wall and the recess strips support the sides of beam pocket. The recessed furring strips at the corners, shown in conjunction with the concrete columns, cannot support to hold the wet concrete within the panel. The panel does not appear strong enough to support the wet concrete at the columns and especially at the wall corners. The columns are limited in size based on the size of the wall and require specially made forms to create different sizes.

In US 2008/0066408 (filed Sep. 14, 2006) by Hileman is a rigid foam block that has six vertical chambers and a horizontal mold at the top and bottom of each the foam block. When the rigid blocks are installed together they will form a wall with an array of small vertical and horizontal chambers into which concrete is then poured. The rigid foam block limits the concrete column and beam spacing for a wall.

C. Composite Panel

A composite panel are panels not formed with neither light gauge framing or rigid foam block type construction.

In U.S. Pat. No. 6,041,562 (filed Feb. 17, 1998) by Martella is a panel formed by polymer-modified fiber reinforced concrete material at the inner and outer surfaces of the panel along with panel spacers separating the inner and outer surfaces. A synthetic plastic foam is filled between the inner and outer wall surfaces. The panel spacers form chambers where concrete columns and beams can be poured. The size of the columns and beams is limited to the strength of the glue holding the panel together. In fact Martella even mentions that temporary bracing would be required.

D. Solid Continuous Concrete Poured Wall.

These patents are not the typical ICF blocks that come in a variety of patent claims. These solid concrete walls are made uses varies techniques and some do combine some light gauge framing.

In US 2006/0251851 (filed Feb. 24, 2006) by Bowman uses various combinations of metal channels, that are embedded into rigid foam to create numerous configurations for a continuous concrete poured wall as well as a precast wall and flooring system. The embedded metal channels connect both sides of the wall form together. The only beams that are formed are within exterior surface of the precast wall or flooring system. No other columns or beams are developed by this patent.

In U.S. Pat. No. 6,681,539 (filed Oct. 24, 2001) by Yost uses metal channels on the exterior of foam panels and connect both sides of the panel together by wire and attaching them by retaining clips on the exterior on the wall. The space between the panel halves is a continuous concrete wall. The insulated form does not contain a column or beam with the wall.

In U.S. Pat. No. 6,880,304 (filed Sep. 9, 2003) & U.S. Pat. No. 7,409,800 (filed Dec. 10, 2003) by Budge uses two sheets of rigid foam with grooves cut at the vertical edges of the rigid foam. A ½ channel is installed at each vertical groove and the ½ channels on both sides of the wall interlock, forming a continuous form to pour a concrete wall. This patent and U.S. Pat. No. 6,523,312 by Budge (described earlier) both have the same abstract, however the earlier described patent contained the column and beam of which does not reflect the patent pending.

In U.S. Pat. No. 7,254,925 (filed Jul. 21, 2003) by Steffanutti uses metal channels with a rigid board to form a free-standing column with a hole in it, in lieu of pouring a solid concrete column. The window and door construction shows ports for receiving concrete to form doors and windows plus a removable strip for forming a window.

E. Triangular Stud

Light gauge metal is configured in many different shapes and therefore a forming mold should be analyzed with many different shapes.

In U.S. Pat. No. 5,279,091 (filed Jun. 26, 1992) by Williams also uses a triangular flange and a clip to install a demountable building panel of drywall.

In U.S. Pat. No. 5,207,045 (filed Jun. 3, 1991), U.S. Pat. No. 5,809,724 (filed May 10, 1995), U.S. Pat. No. 6,122,888 (filed Sep. 22, 1998), by Bodnar described a triangular stud and in U.S. Pat. No. 7,231,746 (filed Jan. 29, 2004) by Bodnar shows wall studs that are wrapped and a concrete column are cast within the framing of a precast wall.

F. Insulation filled after Wall Installed

The patents below describe various types of insulation used when constructing a wall including wet foam, loose granular fill insulation and dry cellulose fiber insulation.

In U.S. Pat. No. 5,655,350 (filed Jul. 18, 1994) by Patton installs a fire stop by installing a insulated material through holes at the interior side of a wall. In U.S. Pat. No. 5,819,496 (filed Apr. 28, 1997) by Sperber installs loose filled insulation particles in a wall using a netting material and using cavities holes for filling the wall voids. In U.S. Pat. No. 6,662,516 (filed Nov. 16, 2001) by Vandehey strengthens existing walls by injecting cavity walls with adhesive foam through holes in the sides of the walls. The adhesive foam is installed in layers and allowed to dry between additional layers. In U.S. Pat. No. 5,365,716 (filed Aug. 2, 1993) by Munson installs dry cellulose fiber insulation into a stud cavity wall by installing a vapor barrier to studs and then filling the cavity wall using a pneumatically pressure hose into the sides of the cavity wall. All the above patents are typically installing the insulation from the side through holes after the wall has installed. Loose insulation has been installed from the top of masonry walls for a long time.

G. Foam Panel

In U.S. Pat. No. 5,943,775 (filed Jan. 7, 1998) and U.S. Pat. No. 6,167,624 (filed Nov. 3, 1999) and U.S. Pat. No. 6,681,539 (filed Oct. 24, 2001) by Lanahan uses a polymeric foam panel with metal channels installed within the foam. The panels are interlocked together by a tongue and groove connection using the foam as the connector. An electrical conduit is horizontally installed within the panel for electrical distribution. The metal channels are embedded within the foam. None of the Lanahan patents use their panels to form concrete columns or beams.

H. Foam Tape on Studs

Foam tape is shown on metal and wood channels to reduce the conductivity between different building materials.

In U.S. Pat. No. 6,125,608 (filed Apr. 7, 1998) by Charlson shows a insulation material applied to the flange of an interior support of a building wall construction. The claims are very broad since insulating materials have been applied over interior forming structures for many years. The foam tape uses an adhesive to secure the tape to the interior building wall supports.

I. Corrugated Fiberboards

Products like waferboard, fiberboard and the like are now being developed to play more of factor in building walls and floors. In addition many of the products have the same or more of an insulation factor than rigid insulation.

In U.S. Pat. No. 7,077,988 (filed Jul. 18, 2006) by Gosselin uses a corrugated wooden fiberboard panel to attach to a concrete block wall and explains the system to manufacture. In U.S. Pat. No. 6,541,097 (filed Apr. 11, 2001) by Lynch developed a ribbed board product to be used for decking. In U.S. Pat. No. 6,584,742 by Kilgier uses metal channels and strand board at the interior with inner and outer facing layers. Vertical and horizontal structural steel is used to help support the panels. The materials being produced today are getting more sophisticated for example U.S. Pat. No. 7,232,605 by Burgueno is a hybrid natural-fiber composite panel with cellular skeleton tubular openings. The hybrid natural-fiber panel also has a greater strength than other types of products. It also can be used in place of rigid insulation to create the same energy efficiency as rigid insulation.

J. Plastic or Related Panel Connectors

The connector type patents are typically full width poured concrete walls. The plastic connectors hold the panels together and are made of various configurations.

In U.S. Pat. No. 5,809,726 (filed Aug. 21, 1996), U.S. Pat. No. 6,026,620 (filed Sep. 22, 1998) and U.S. Pat. No. 6,134,861 (filed Aug. 9, 1999) by Spude uses a connector that has an H shaped flange at both ends of the connector and connected by an open ladder shaped web. The connector is not a ICF block type connector, but long and is used both vertically and horizontally within the wall. All the Spude patents refer to a full width poured concrete wall. Sometimes the connector is located at the exterior surface, another is embedded within the panel surface.

In U.S. Pat. No. 6,293,067 (filed Mar. 17, 1998) by Meendering uses the same H shaped flange at both ends of the connector, however the web configuration is different. Also in U.S. Pat. No. 5,992,114 (filed Apr. 13, 1998) & U.S. Pat. No. 6,250,033 (filed Jan. 19, 2000) by Zelinsky also uses the same H shaped flange at both ends of the connector, also uses a different web configuration. Also in U.S. Pat. No. 6,698,710 (filed Dec. 20, 2000) by VanderWerf also uses the same H shaped flange at both ends of the connector, also uses a different web configuration.

In U.S. Pat. No. 6,247,280 (filed Apr. 18, 2000) by Grinshpun has an inner and outer skin which has an interlocking means built-in the interior surface of the panel skins. The ends of a panel connector are V shaped and lock into the interior interlocking means of each of the building panels. The connector also can accommodate a rigid insulation board within the interior of the wall panel. The panel construction is used for a continuous concrete wall, and does not affect this patent application.

In U.S. Pat. No. 6,935,081 (filed Sep. 12, 2003) by Dunn embeds an H shaped configuration in both sides of the wall panel which is rigid insulation. The H shaped configuration also has a recessed area into which a "spreader" can be installed. The spreader is another H shaped member that can slide into the recess of each side of the wall panel. The spreader also would be considered a web configuration is some of the above described patents. These spreaders are shown to be extended above the panels and slide into the recess of the above panel. Since these spreaders are made of plastic, the spreaders are easily breakable especially when trying to align them with the recessed grooves above.

In U.S. Pat. No. 5,566,518 (filed Nov. 4, 1994) by Martin uses rigid insulation as the sides of the wall panel. The interior side of each wall panel is scallop to form a vertical columnar shape as well as a horizontal shaping beam. The side walls are connected by a snap-on plastic connector that fits over the edge of the side walls. When connected the rigid insulation along with the plastic connector really just form another type of ICF blocks except here the scallops adds more expensive and doesn't really serve any function.

In U.S. Pat. No. 7,185,467 (filed Oct. 6, 2003) by Marty, uses a GRC as the mold form to pour concrete columns and beams. No explanation is given on how the panels are separated except of the sides like by windows. These panels would be a very expensive to fabricate as well as to install at a construction site. The beams and columns have no relationship to the present invention.

In US 2007/0062134 (filed Sep. 22, 2005) by Chung uses vertically oriented Aerated concrete panel to form a wall and then fill with concrete to form a column or beam within the wall. The pending patent by Chung also has no relationship with the present invention.

K. Baffles Within Walls

Typically baffles in building construction are used in attic roofs to allow for air to circulate through the eaves into the attic. Some baffles have been used within walls to increase the insulation factor where mechanical lines occur.

In U.S. Pat. No. 6,754,995 (filed Sep. 25, 2001) by Davis shows a baffle used between wall studs or roof rafters and are typically used to allow air to circulate within a wall or roof attic. The Davis patent describes many different types of baffle patents, however none of the baffles are being used to separate concrete from insulation within a wall nor are used as a brace for a wall stud.

L. Precast Concrete Thin Panel Poured Face Down

Precast concrete panels when poured face down have the metal framing installed when the concrete face is being poured and other patents the metal framing is installed after the concrete has cured. None of the patents have a framing system in conjunction with a rigid insulation core as well as a structural insulated panel (SIP).

Most of the precast panel poured face down have the metal framing embedded into the concrete like Schilger in U.S. Pat. No. 4,602,467, Bodnar in U.S. Pat. No. 4,909,007 & U.S. Pat. No. 6,708,459, Staresina in U.S. Pat. No. 4,930,278, Cavaness in U.S. Pat. No. 5,526,629, Ruiz in U.S. Pat. No. 6,151,858. In the 3 patents by Foderberg U.S. Pat. No. 6,817,151, U.S. Pat. No. 6,837,013 & U.S. Pat. No. 7,028,439 the hat channel is secured to the metal channel and one is separated by a thermal break at the flange. The Nanaykkara U.S. Pat. No. 6,988,347 & U.S. Pat. No. 7,308,778 both are cast face down however in U.S. Pat. No. 7,308,778 has insulation between the two precast panels. In Rubio at U.S. Pat. No. 7,278,244 uses a bracket which is attached to the metal channel. In Cooney U.S. Pat. No. 5,138,813 has a bracket that is inserted and then fastened to the metal channels.

M. Precast Concrete Thin Panel Poured Face Up

The concrete panels poured face up have the metal channels embedded into concrete or poured concrete over rigid insulation with a connector attached. Precast concrete panels when poured face up, typically have the metal framing installed when the concrete face is being poured.

The patent by Mancini U.S. Pat. No. 5,758,463 and LeBlang U.S. Pat. No. 6,041,561 both showing the metal channels embedded into the concrete and patents by LeBlang U.S. Pat. No. 6,041,561 and Spencer U.S. Pat. No. 6,729,094 showed a connector attached to the metal channel and rigid insulation sheathing.

N. Precast Concrete Wall with Exposed Insulation

In Moore U.S. Pat. No. 6,438,918 & U.S. Pat. No. 6,481,178 use an ICF as a form and a precast concrete facing is attached to the ICF.

O. SIP

Structural insulated panels known as SIP's are typically made using rigid insulation in the middle with plywood on both sides and wood blocking or metal connectors are installed in the middle connecting the two panels together.

Porter has developed many SIP patents using metal components including U.S. Pat. No. 5,497,589, U.S. Pat. No. 5,628,158, U.S. Pat. No. 5,842,314, U.S. Pat. No. 6,269,608, U.S. Pat. No. 6,308,491, and U.S. Pat. No. 6,408,594 as well as Babcock U.S. Pat. No. 6,256,960, Brown U.S. Pat. No. 6,564,521 and Kligler U.S. Pat. No. 6,584,742 of which Babcock shows a metal channel between two panels to interlock adjacent panels. Porter shows 5 more patents using wood and one more U.S. Pat. No. 5,950,389 using splines to interlock panels. Frost in U.S. Pat. No. 6,568,138 uses holes in base plate for predetermine metal stud spacing.

P. Column & Beam Between Two Modular Buildings

Prefabricated modular building units when place adjacent to each other form a double wall.

In Mougin U.S. Pat. No. 3,678,638 uses a steel mold to form specially configured beams between modular building units. The wall system does not interconnect to a flooring system and the concrete columns are not integrated into the wall construction without having to construct a wood form.

Q. GFRC Applied to the Foam.

Many different types of finishes can be applied directly to the foam like Glass Fiber Reinforced Concrete (GFRC) as well as different type of stucco finishes.

Various patents have applied GFRC to form foam panels for example, Grieb in U.S. Pat. No. 4,774,794 has an interlocking panel where GFRC completely covers all four sides; Baldwin in U.S. Pat. No. 6,851,235 makes a foam block with GFRC; Jensen in U.S. Pat. No. 6,869,669 makes a sandwich panel with the GFRC covering all four sides and intermediate middle sections for support and Walpole in U.S. Pat. No. 7,395,999 embeds a metal channel in foam for support and uses a tongue & groove joint sealer between panels. Stott in U.S. Pat. No. 6,355,193 figures the foam into stone and then applies the GFRC.

R. No Relationship to Invention—Appeared Significant

In U.S. Pat. No. 5,335,472 (filed Nov. 30, 1992) & U.S. Pat. No. 6,519,904 (filed Dec. 1, 2000) by Phillips initially developed a patent where a concrete wall is formed by pneumatically applying concrete to a foam panel with a wire mesh layer. A concrete column is pneumatically applied in the U.S. Pat. No. 5,335,472 and a vertically poured concrete column in the second patent using metal channels, a forming plate and pneumatically placed concrete wall as the concrete form. None of the Phillips patents relate to the pending patent.

There are many ICF's manufactured, for example, U.S. Pat. No. 6,647,686, U.S. Pat. No. 5,992,114 (plastic connector), U.S. Pat. No. 6,378,260, U.S. Pat. No. 6,609,340, US 2001/0027630, US 2007/0278381 just to name a few.

SUMMARY OF THE INVENTION

The enclosed building construction is a new method of construct a concrete post and beam structure within a wall using light gauge metal or plastic framing components, inner and outer rigid boards and a spacer insulation or foam spacer at the wall mold interior. The concrete column and beam molds are made using a rigid framing structure, along with the inner and outer rigid boards and either spacer insulation or foam spacer to form a mold to pour a concrete beam and column structure. The size of the column is defined as the width of the interior framing member and the length is determined by the amount of dead and live load the column is expected to carry. The larger the load the more framing supports would be required in order to secure both sides of the forming mold. This might typically happens at the corner of a building where horizontal wind forces combine with additional vertical loads creating a larger column size of possibly 4" by 30" in one direction and another 4" by 30" column attached in the wall at typically 90 degrees to the first column.

Another type column is one that is wider than the width of the wall, but yet incorporated the wall forming mold as part of the column forming mold. This wider column size requires a larger framing support that protrudes from the forming mold. In addition an insulated flange framing component can be used as an independent wall framing components or in conjunction with a concrete poured wall or column.

Not all structures are supported by concrete footings, foundation or concrete slab on grade construction, but are supported by caissons. Caissons are vertical columns below ground that support an above ground structure by friction or end bearing. The greater the length or increased diameter of a caisson, the greater the load or weight the caisson can carry. The caisson can be placed anywhere within a building, typically under a wall or where a column occurs above. A column mold within a wall mold should have the flexibility to change size and location to fit the structural load capacity the column is required to carry. In addition the concrete column within a wall should be able to also have the flexibility to have an array of columns within a wall. In the World Trade Center building in New York, the architect Yamasaki designed that building to have an array of columns on the exterior of the structure. The patent pending allows for variations in the structural spacing of columns and the size of beams to change the structural integrity of the forming structure to fit the need of architects and builders.

In U.S. Pat. No. 6,401,417 by LeBlang shows how a concrete column and beam can be installed within a wall using metal channels and rigid insulation/hardboard. The wall forming structure extends through the wall to above the beam. The support for the beam is rigid foam, however in the pending patent; the insulation material will support the beam until the concrete cures. The wall mold at the wall beam can vary within the wall without having to change the wall configuration. When a floor construction intersects the wall beam, the wall beam can change accordingly. For example ledger beam that supports the floor can be mounted directly on the wall form structure along with the joist hangers and anchor bolts to support the flooring system. The ledger board now is part of the forming mold and also is a horizontal bracing member to secure a stronger mold structure. The floor beam now also becomes a natural fire stop within the building construction. Since the joist hangers are installed prior to the concrete columns and beams are installed in the wall, the floors joists that are outside of the patent pending can be used as a scaffold for pouring concrete into the wall mold.

One method described earlier is to have the exterior width of the beam be the same width as the width of the form structure. There are times when the beam width has to be wider, and the patent pending gives that flexibility by extending the wall forming structure into the wider horizontal beam.

A previous patent pending application US 2007/0044392 by LeBlang, showed modular building units stacked adjacent to one another as well as on top of one another. When stacked adjacent to one another the space between the units is the exposed C channels and the interior finish of the modular units. A column forming structure is formed when a full depth spacer is connected between one module and another. The size of a concrete column will vary depending on the load capacity of the column. Several C channels will be spaced close to one another on each module and spacers will connect the modules together plus additional steel reinforcing can be added within the column to form the column between modules.

A concrete beam can be formed also using two adjacent modules. One-half of a beam is formed on one module and the other half of the beam is formed on the adjacent module. After the modules are secured together with the module spacer connectors, a horizontal rigid board can be stalled above the ceiling rim joists. Horizontal hat channels are attached to the vertical C channels and a rigid board is secured to the hat channels. The vertical and horizontal rigid boards form a horizontal beam. After all the modules for a particular floor of a building are installed, the concrete can now be poured into the multiple columns and beams within the building structure. The module forming structure within the module walls, extend above the top of the beam mold. The module above will rest onto the top of the concrete beam and against the vertical forming structure from the module below. The module forming structure from the module below can now be secured to the rim joist of the upper modules floor system. Additional steel reinforcing can be added through the holes of each module. Again after the modules are placed adjacent to each other, the module spacer connectors are now connecting each module. The horizontal rigid board forming the beam can also be built using rigid insulation material between the vertical forming structure of both modules plus an angle on the interior between the modules.

The beams and columns can be formed using completed modules or panelized sections which comprise the same components as a module unit. The previous patent pending application, showed a concrete beam within a wall structure which consisted an array of metal channels and rigid insulation. I did want to note that the size and or gauge of the metal channels can greatly be reduced, because the metal channels are not the support for constructing the wall, but rather a means of attaching the interior and exterior finish to the wall which in the method to form the wall column or beam. As mentioned earlier, the foundation and footing can be poured at the same time, therefore supporting the walls above ($1^{st}$ floor) without using a wall brace or hurricane tie down. By installing concrete blocks below the metal supports, the wall can be plumb and straight prior to any concrete installed within the footing as well as the wall.

Another aspect of the pending patent is that either spacer insulation, foam spacer or foam material not only creates a thermal break between the structural support members in a wall, but also allows fasteners to secure drywall and siding into a concrete wall after the concrete has cured. The fasteners can penetrate the structural support members and a second layer of foam material allows the threads of the fastener to be secured to the structural support members without having to penetrate the concrete.

Another aspect of the pending patent is that the foam material created a bent flange channel and a double flange channel allowing the foam material to easily be secured to the wall forming structures.

Another aspect of the pending patent is that the spacer foam can be formed to include the area shown as the foam material creating the thermal break between the wall forming structures as well as an insulated wall. This structural insulating core of channels and foam spacer can be used as the center core of a concrete column and beam wall mold or as just a framed wall using the support channels and either spacer insulation or foam spacer for a conventional framed wall. The spacer insulation is formed using tongue and groove sides so as to easily slide into place between the channels. This interlocking foam core can glue together to form panels as well as to form structural insulated panels (SIP's) with the exterior and interior faces glue together to form one panel.

Another aspect of the invention is that exterior wall sheathing and interior rigid insulation in a wall are formed as one and together form an integrated material referred to as foam spacer. The integrated wall sheathing speeds construction since usually two different construction trades installs the wall sheathing and the interior insulation and the rigid insulations provides a measurement say 16" or 24" on center for a faster wall installation.

Another aspect of the invention is to form thin-cast precast walls using the structural insulating core and a forming bed when pouring the concrete over the top (face up) on to the structural insulating core. Additional columns and beams can be formed by removing sections of the foam spacer integrating the columns and beams into the thin-cast concrete face of the precast panel.

Another aspect of the invention is to form thin-cast precast walls using a connector attached to the insulating channels or to the structural insulating core and embedding the connector into the concrete bed. Concrete columns and beams are poured where the spacer foam is not located.

Another aspect of the pending patent is that by installing baffles at the ICF block form support braces, the baffle compartmentalizes the interior of a wall mold structure to form a vertical chamber to form a column. The space between the columns can now be filled with loose granular insulation along with a horizontal baffle at the bottom of a horizontal beam. Together the baffles form a column and beam structure into which concrete can be poured.

Another aspect of the pending patent is the use or corrugated and rigid fiberboards to create wall forming molds and still maintain the high energy efficiency of this type of wall mold systems.

Another aspect of the pending patent is the formation of an insulated flange in a wall forming structure. The insulated flange can be used as an independent framing member or can be installed within a concrete column or continuous concrete wall. The insulated flange allows concrete to flow around the insulated flange allowing future penetrations into a concrete wall like screws or nails to easily be fastened into a concrete structure. In addition, a scaffolding connector could easily be attached to the interior forming structure as well as removing the scaffolding support connector as well as installing and removing any temporary bracing after the concrete is installed within the molds.

DESCRIPTION OF THE PREFERRED EMBODIMENTS

A building construction and method of forming various wall molds using the various column and beam molds within the panel mold configurations. The various column and beam molds form various wall panel molds which when installed vertically form a building construction and a forming structure into which a poured hardenable material such as concrete into the forming structure to form a continuous concrete column and beam structure. Various types of wall molds are formed using a structural insulating core comprising of support channels and spacer insulation or support channels, spacer insulation, rigid insulation, rigid boards plus a reinforcing means into the beams or columns molds.

Figure 1:
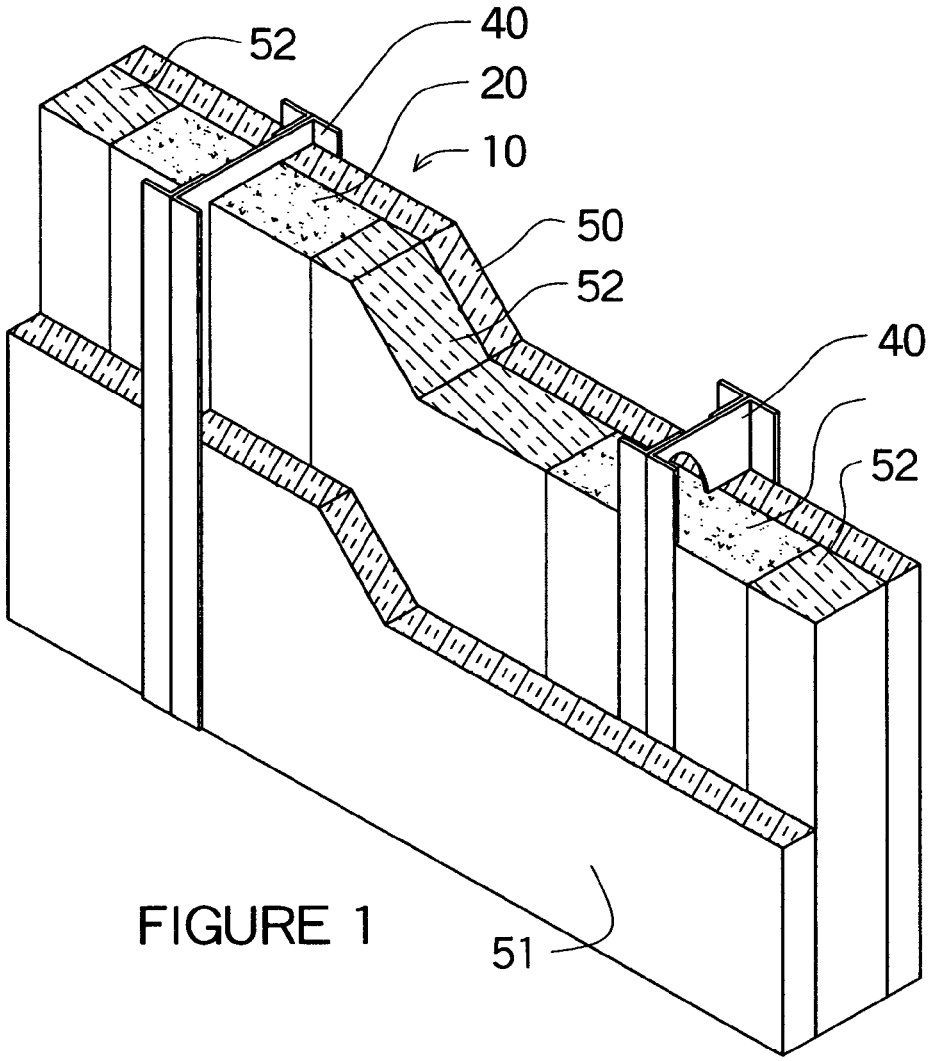
FIG. 1 is an isometric view of a column in a building wall using a wall mold structure in the middle of the column.
Figure 2:
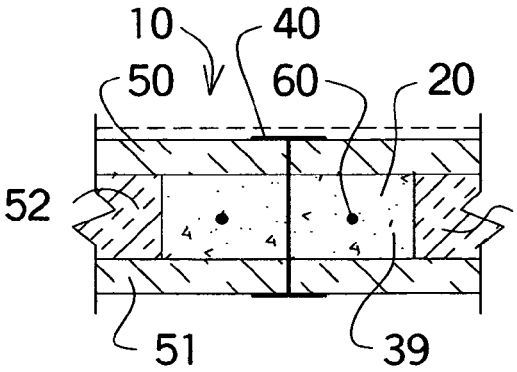
FIG. 2 shows a plan view of a column within the building wall straddling the wall forming mold.
Figure 3:
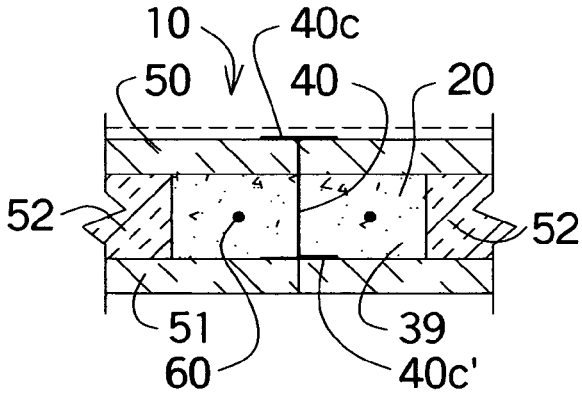
FIG. 3 shows a plan view of a column within the building wall partially embedded with the wall forming mold.

After review of the existing and pending patents, one can recognize the differences in this patent application. In FIG. 1 a wall mold 10 is shown in isometric view with two different configurations of column molds 20. The wall mold 10 consists of a rigid board 50 and rigid insulation 51 are the inner and outer rigid boards that define the outer surfaces of the wall mold 10. The interior of the column molds 20 are also shown in a plan view drawing in FIG. 2 and FIG. 3. The width of the column molds 20 are determined by the thickness of the spacer insulation 52 located between the rigid board 50 and the rigid insulation 51. On the other hand, the width of the column molds is the distance between the spacer insulation 52. In FIG. 2 the support channel of the column forming structure is an H channel 40 shown at the middle of the column mold 20 extending outside of the wall mold 10 but yet an integral part of the column mold 20 securing both the rigid board 50 and the rigid insulation 51 to the wall mold 10. In FIG. 3 the H channel 40 is smaller than in FIG. 2 which allows the rigid insulation 51 to be secured to the outer surface of flange 40*c* of the H channel 40. The opposite flange 40*c*' of H channel 40 is secured on the interior surface of the flange 40*c*' making it easier to fasten another material to the H channel 40. Since no fastening means is shown connecting the spacer insulation 52 to either the rigid board 50 and rigid insulation 51, the material has to be compatible so an adhesive (not shown) can connect the various materials together. The depth of the column molds 20 are determined by the structural strength of the adhesive and the bending stress of the rigid board 50 and rigid insulation 51. On the other hand, the rigid board 50, rigid insulation 51 and the spacer insulation 52 could all be formed of the same material and secured together with the H channel 40. Steel reinforcing 60 can be added prior to the column molds 20 being filled with a hardenable material.

Figure 4:
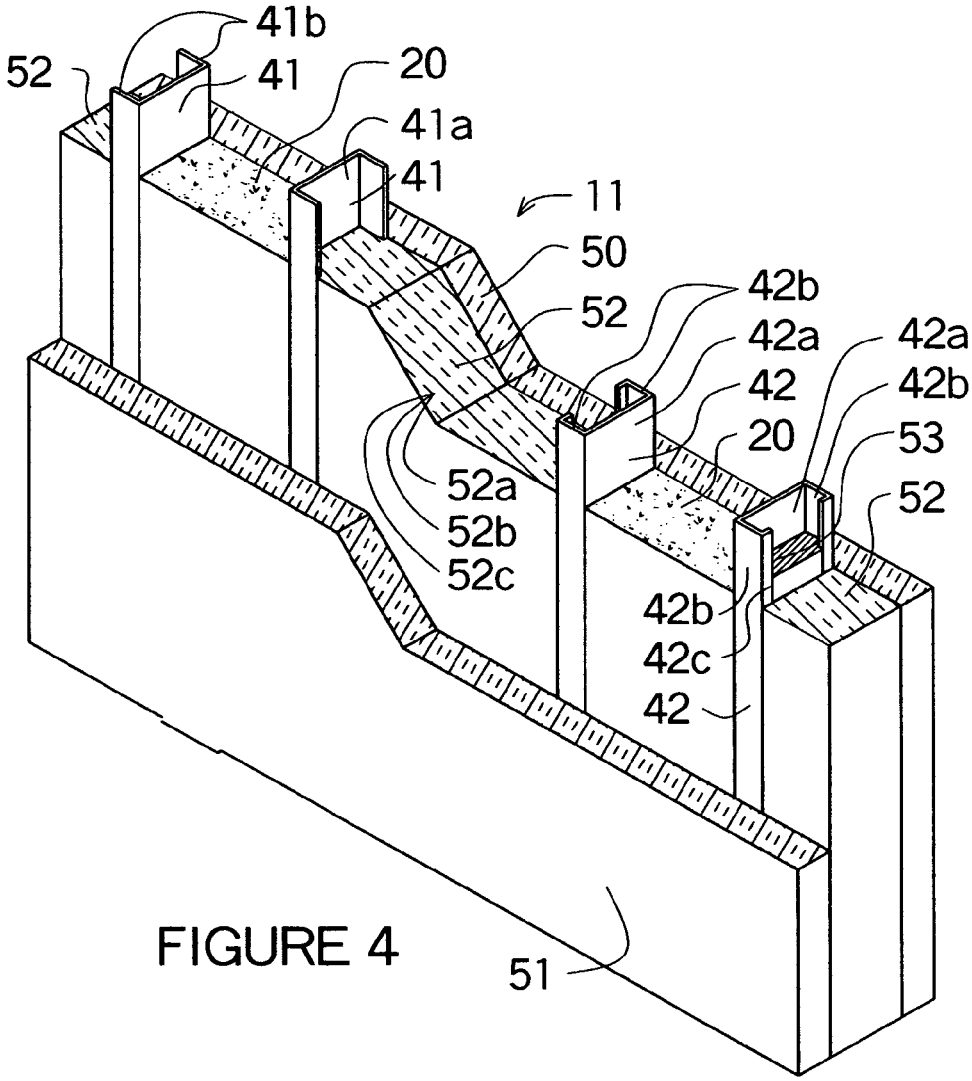
FIG. 4 is an isometric view of a wall column using two U or C channels to help support the column mold.
Figure 5:
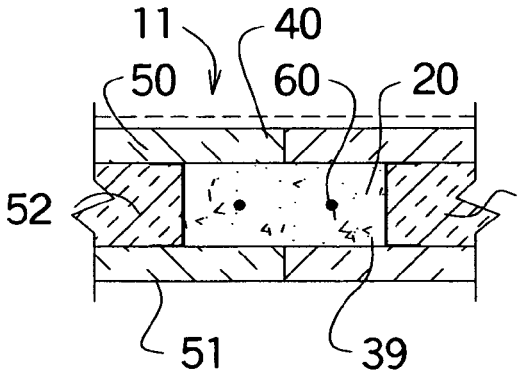
FIG. 5 is a plan view showing the U channels supporting the wall mold.
Figure 6:
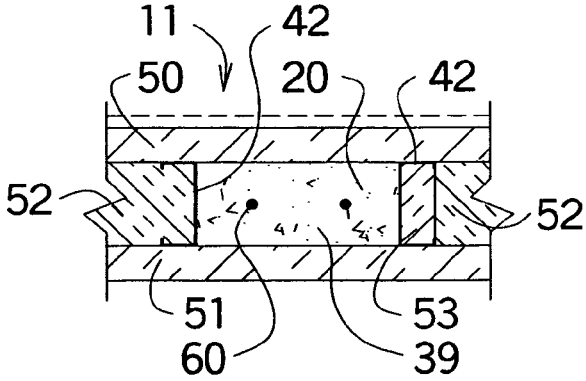
FIG. 6 is a plan view showing the C channels supporting the wall mold.

In FIGS. 4-6 a wall mold 11 is shown in isometric view with two column molds 20. The wall mold 11 consists of a rigid board 50 and rigid insulation 51 as the outer surfaces of wall mold 11 along with the spacer insulation 52 between the outer surfaces. The column forming structure within the column mold 20 shown in FIGS. 4 & 5 consists of two support channels shown as U channels 41. The flanges 41*b* are secured to the rigid board 50 and the rigid insulation 51 along with the spacer insulation 52. The spacer insulation 52 fits securely between the web 41*a* of each U channel 41. The space between the web 41*a* of the U channel 41 define the depth of the column mold 20. In FIG. 6 the column mold 20 uses support channels shown as C channels 42 to function in a similar capacity as the U channels 41 in FIG. 5. The C channels 42 in FIG. 6 have a lip 42*c* to give the column mold 20 additional strength. As like FIG. 5 the web 42*a* the C channels 42 define the width of the column mold 20. The C channel 42 is shown with rigid foam 53 at the interior of the C channel 42. The rigid foam 53 is secured within the C channel 42 by the two flanges 42*b* and the web 42*a* and the lip 42*c*. The rigid foam 53 eliminates any air infiltration that could occur within the C channel 42. Since the wall mold 11 has the U channels 41 or the C channels 42 as part of the column mold 20, the spacer insulation 52 can be installed as part of the wall mold 11 or the spacer insulation 52 can be installed after the wall mold 11 has been installed in a vertical position. When the spacer insulation 52 is a solid material the spacer insulation 52 can be fabricated as part of the wall mold 11 and prior to erecting the wall mold 11. On the other hand if the spacer insulation 52 is not installed prior to the wall mold 11 being erected, a loose granular insulation material 52*a* can be poured into the area occupied by the spacer insulation 52 through the top of the wall mold 11. In addition, in lieu of a loose granular insulation 52*a*, a dry cellulose fiber insulation 52*b* or a liquid foam 52*c* can also be filled from the top of the wall mold 11. Typically the spacer insulation 52 is a rigid foam type material, however new products are being developed like hybrid natural-fiber composite panel with cellular skeleton tubular openings which can function the same as a rigid foam material.

Figure 7:
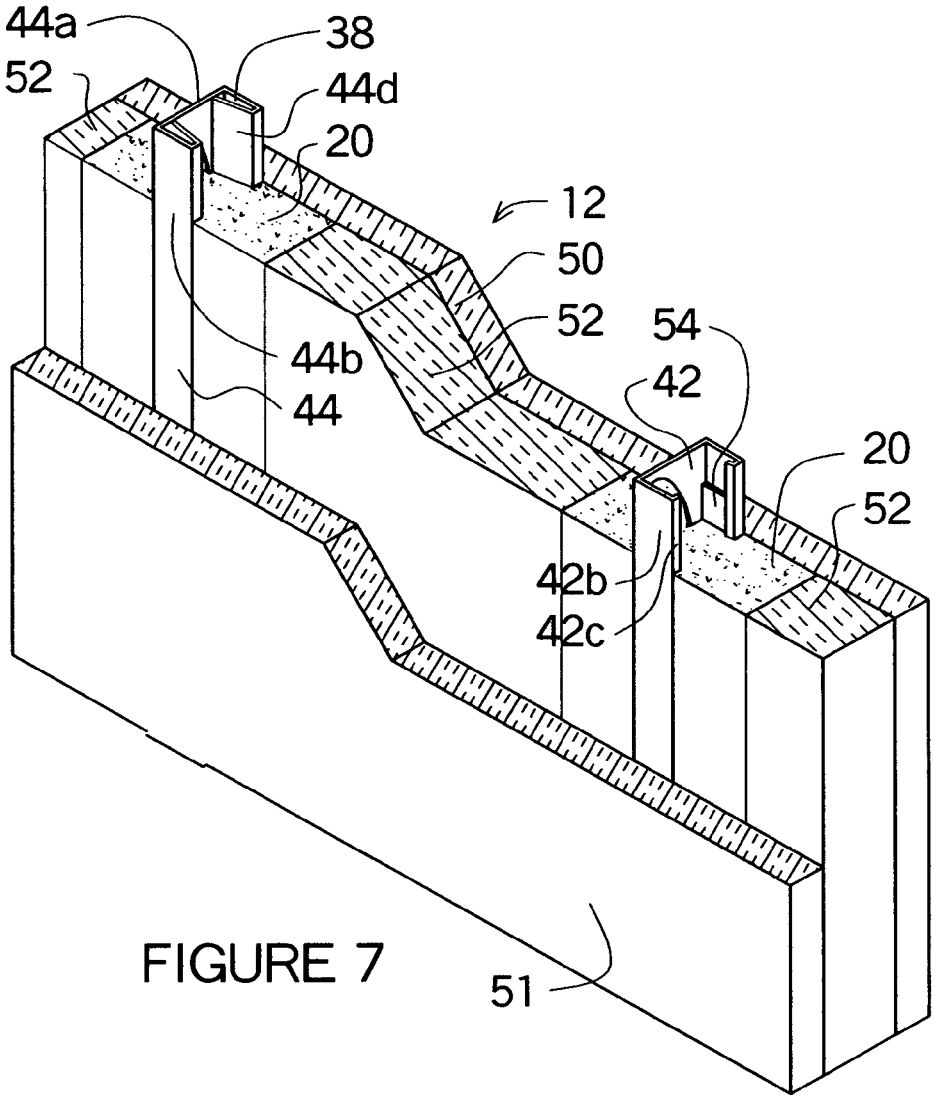
FIG. 7 is an isometric view of two columns one using a bent flange channel at the support channel of the column mold and the other column a C channel.
Figure 8:
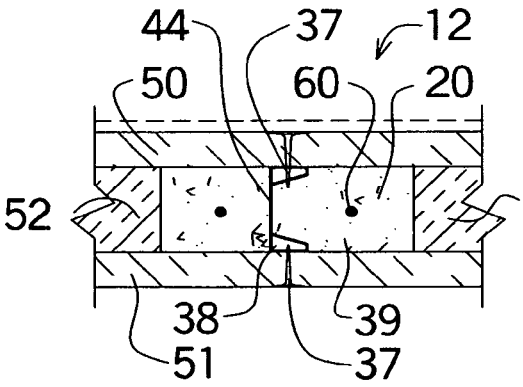
FIG. 8 is a plan view showing the bent flange channel at the center of the column forming structure.
Figure 9:
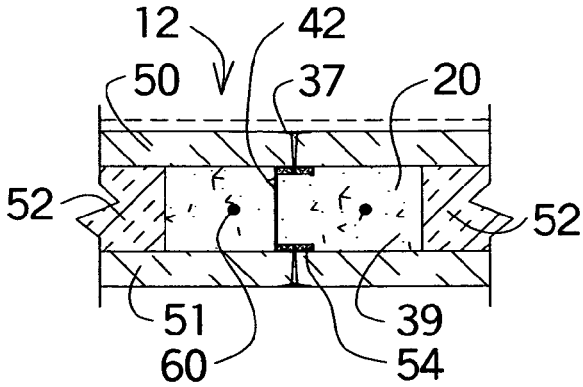
FIG. 9 is a plan view showing a C channels with insulation material at the flange.

In FIGS. 7-9 a wall mold 12 is shown in isometric view with two column molds 20. The wall mold 12 consists of a rigid board 50 and rigid insulation 51 as the outer surfaces of wall mold 12 along with the spacer insulation 52 between the outer surfaces. The distance between the spacer insulations 52 define the width of column mold 20. The plan view in FIG. 8 shows a bent flange channel 44 as the column forming structure and is located in the middle of column mold 20. The bent flange channel 44 has a web 44*a* which is the same width as the spacer insulation 52. The bent flanges consist of two parts, that is 44*b* is adjacent to the rigid insulation 51 and the remainder of the bent flange 44*d* is bent again to be close to the web 44*a*. The double bending of flange 44*b* & 44*d* allows a fastener 37 to secure the bent flange channel 44 at two spots that is the flange 44*b* and 44*d*. Light gauge metal say 25 gauge is not very strong, and the double flanges 44*b* and 44*d* allow two surfaces into which a fastener 37 can attach to and thereby increasing the strength a fastener 37 can attached to support the rigid board 50 as well as resist the force of wet concrete 39 pushing against the rigid board 50. When the wall mold 12 is erected vertically the steel reinforcing 60 is added and the column mold 20 is filled with concrete 39. Upon doing so the web 44*a* and the bent flanges 44*b* & 44*d* create a cavity 38 which is more clearly seen in FIG. 10. Since the cavity 38 is not filled with concrete 39 as typically the small space between the web 44*a* and the bent flange 44*d* is not large enough to allow concrete 39 to flow into. When additional materials shown (in ghost) is applied to the rigid board 50, the fastener (not shown) can then penetrate the rigid board 50 and into the bent flange channel 44 without having to penetrate into the concrete 39 within the column mold 20. In FIG. 9 another column mold 20 (shown in plan view) is formed the same as in FIG. 8, however a support channel shown as C channel 42 is the column forming structure and is located in the middle of the column mold 20. The two flanges 42*b* of the C channel 42 abut the rigid board 50 and the rigid insulation 51. The flanges 42*b* each have a lip 42*c* which is at a right angle to each of the flanges 42*b*. Between the lip 42*c* and the web 42*a* and adjacent to the flanges 42*b* a foam material 54 can be installed using several methods which is also more clearly shown in FIG. 11. When the wall mold 12 is oriented vertically, concrete 39 is installed within the column mold 20 and the foam material 54 becomes encased in the concrete 39. After the concrete 39 has cured within the column mold 20 fasteners 37 can be installed through the C channel 42 and into the foam material 54 without touching the concrete 39.

Figure 10:
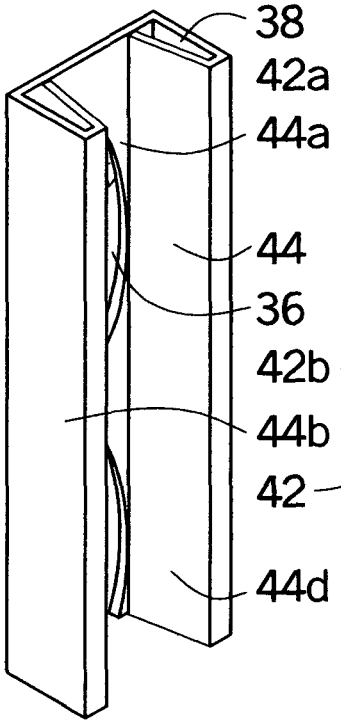
FIG. 10 is an isometric view of the bent flange channel.
Figure 11:
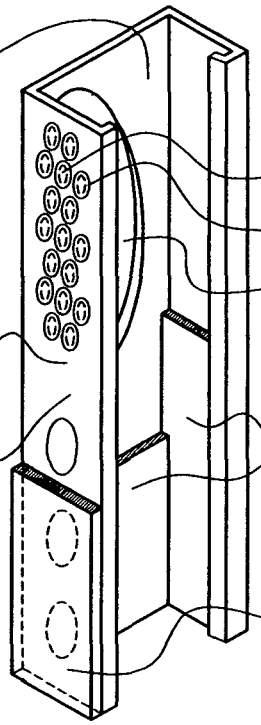
FIG. 11 is an isometric view of a forming structure showing the foam material attached to the interior flange of the forming structure.
Figure 12:
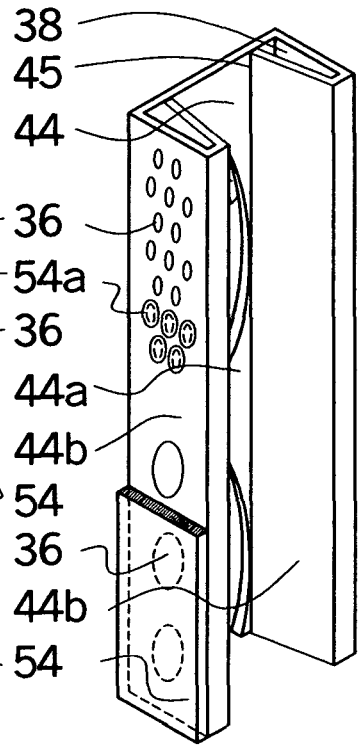
FIG. 12 is an isometric view of a bent flange channel with holes for use as part of the wall forming structure.
Figure 14:
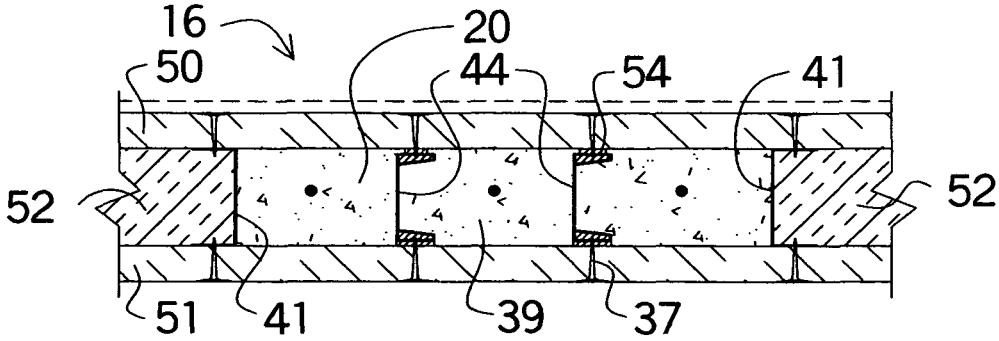
FIG. 14 is a plan view of an elongated column forming structure using two intermediate forming structures with insulation at the outer surface and interior of the flanges.

FIGS. 10-12 are isometric views of several forming structures previously described. FIG. 10 shows an enlarged view of the bent flange channel 44 previously shown in FIG. 8; however this isometric view shows holes 36 in the web 44*a*. In FIG. 12 is the same bent flange channel 44 in FIG. 10, except the flange 44*b* also has holes 36. The holes 36 in the 44*b* flange are used to install foam material 54 into the holes 36 filling the cavity 38 and covering the flange 44*b* with foam material 54. If the foam material 54 is installed in a factory, the foam material 54 will first fill the cavity 38 and then the residual is then removed with a hot knife (not shown) to form a smooth plane parallel to the flange 44*b*. If the foam material 54 is installed at the construction site, the foam material 54 will be soft and when either the rigid board 50 or rigid insulation 51 is secured with fastener 37, the foam material 54 will be of sufficient thickness to separate the rigid board 50 or rigid insulation 51 from the bent flange channel 44 as shown in FIG. 14. Another way to install the foam material 54 is through the gap 45 between the web 44*a* and the bent flange 44*d*. When installing the foam material 54 through the gap 45, located between the bent flange 44*d* and the web 44*a*, the foam material 54 will first fill up the cavity 38 and then the excess will penetrate through the holes 36. Depending when the foam material 54 is applied, the foam material 54 excess will be cut (by a hot knife not shown) to form as smooth plane parallel to the flange 44*b*. FIG. 11 shows the same holes 36 at the flange 42*b* of the C channel 42. The holes 36 are shown with the foam material 54 passing through the holes 36. Depending on the amount of foam material 54 that has been installed through the holes 36, the foam material 54 shown on the flange 42*b* or 44*b* will form a bell shape 54*a* or the foam material 54 when smoothed will form a solid rectangular shape 54*b*. In FIG. 11 the foam material 54 is shown on the web 42*a* which is typically used around windows and doors for securing them to the web of the column forming structure like 42*a*.

Figure 13:
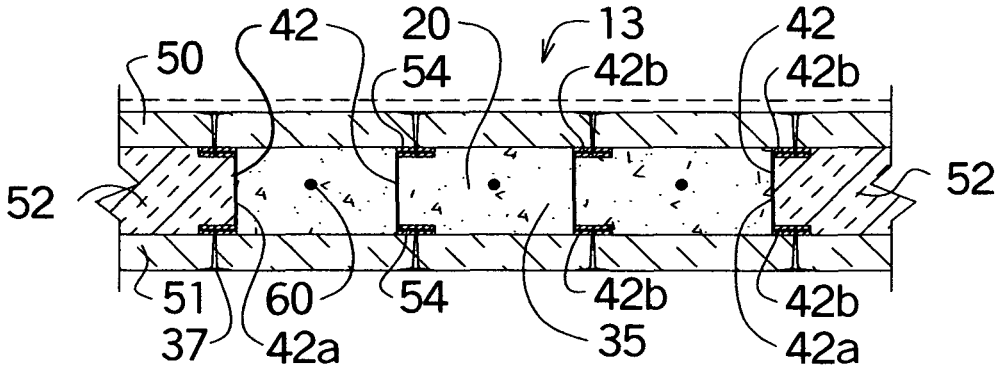
FIG. 13 is a plan view of an elongated column forming structure using two intermediate forming structures.

The FIGS. 13-14 shows the wall molds 13 & 16 which consists of a rigid board 50 and rigid insulation 51 as the outer surfaces of the wall molds 13 & 16 along with the spacer insulation 52 between the outer surfaces. In FIG. 13 the column forming structure shown in column mold 20 consists of four support channels shown in FIG. 11. For clarity purposes, the two C channels 42 that are located in the middle of the column mold 20 are shown with the foam material 54 at the flanges 24*b* as shown in FIG. 11. The two C channels 24 shown at the spacer insulation 52 are also shown with the foam material 54*b*, however the foam material 54 can be eliminated if the spacer insulation 52 is cut slightly differently. The distance between the two webs 42*b* of the C channel 42 that encase the spacer insulation 52 is the total width of the column mold 20. The depth of column mold 20 is the distance between the outside surfaces of the foam material 54 of both flanges 42*b* more clearly shown in FIG. 11. The number of C channels 42 will vary depending size and structural requirements of the concrete column 35 and the steel reinforcing 60 required. FIG. 14 is similar to FIG. 13, except here the column forming structure consists of two support channels shown as bent flange channels 44 in the middle of the column mold 20 and two U channels 41 shown at the ends of column mold 20. Like in FIG. 13, the foam material 54 is adjacent to the bent flange channel 44 as well as the rigid board 50 and the rigid insulation 51. Any additional material (shown in ghost) may be attached with fasteners 37 after the concrete 39 has cured in either the column molds 20 because both the C channel 42 and the bent flange channel 44 have foam material 54 behind the flanges 42*b* & 44*b* of their respective channels.

Figure 15:
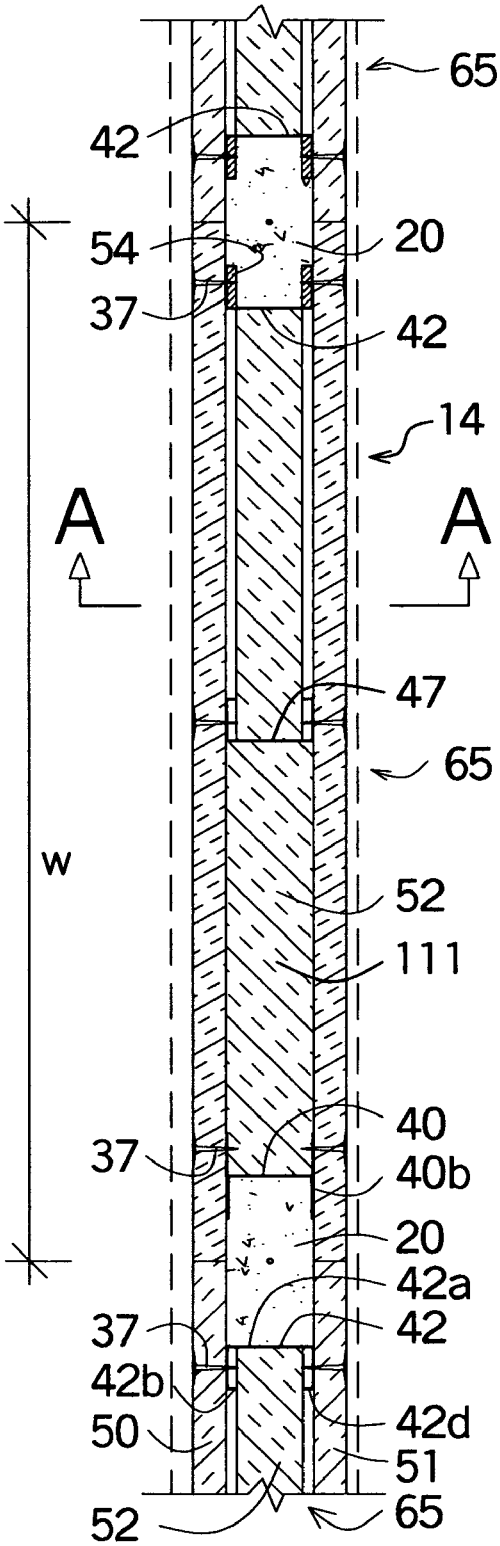
FIG. 15 is a plan view of panel incorporating some of the forming structures previously described.

In FIG. 15 is a plan view of wall mold 14 which consists of three wall panels 65 that is one wall panel 65 is in the middle and two wall panels 65 are located on side of the wall panel 65. The width of wall panel 65 is from the centerline of one column mold 20 to the centerline of the other column mold 20 and the desired height of a building wall as shown FIG. 24. The three wall panels 65 all show rigid board 50 and rigid insulation 51 extending to the centerline of one column mold 20 to the centerline of the other column mold 20 as the inner and outer surfaces; however all three columns molds have a slightly different configurations within the wall mold 14. The lower partial wall panel 65 shows one-half of column mold 20 wherein the support channels is shown as C channel 42 and the flange 42*b* is overlapping the spacer insulation 52. By having the flange 42*b* overlap the spacer insulation, additional material like drywall (shown in ghost) can be attached with a fastener 37 to the C channel 42. The spacer insulation 52 is shown as a rigid type insulation that is smaller than the web 42*a* and fits between the lips 42*d* of the C channel 42. The other half of column mold 20 is shown in wall panel 65 where an H channel 40 is used. A portion of the flange 40*b* extends into the spacer insulation 52 which now allows additional material (shown in ghost) to be installed with fasteners 37. The column molds 20 are formed by using the panel configuration at both the ends of wall panel 65 and the ends of the partial wall panels 65. In other words, one-half of column mold 20 is form by the C channel 42 in wall panel 65 and the other one-half column mold 20 is formed with the C channel 42 of the partial wall panels 65. The C channels 42 in both the wall panels 65 have their flanges 42*b* facing within the column mold 20 rather than engaging the spacer insulation 52 as shown in the other column mold 20. In the other column mold 20 both the support channels shown as C channels 42 have foam material 54 shown at the interior of the C channel 42 allowing fasteners 37 to be installed within the column mold 20 after the wall panels 65 has been erected in a vertical position. The width of wall panel 65 varies depending on the number of spacer channels 47 installed within the wall mold 14 and are further described in FIG. 24. When the spacer insulation 52 has the spacer channels 47 added a wall panel 65 a structural insulating core 111 is formed between the inner and outer rigid boards or any of the previous wall molds.

Figure 16:
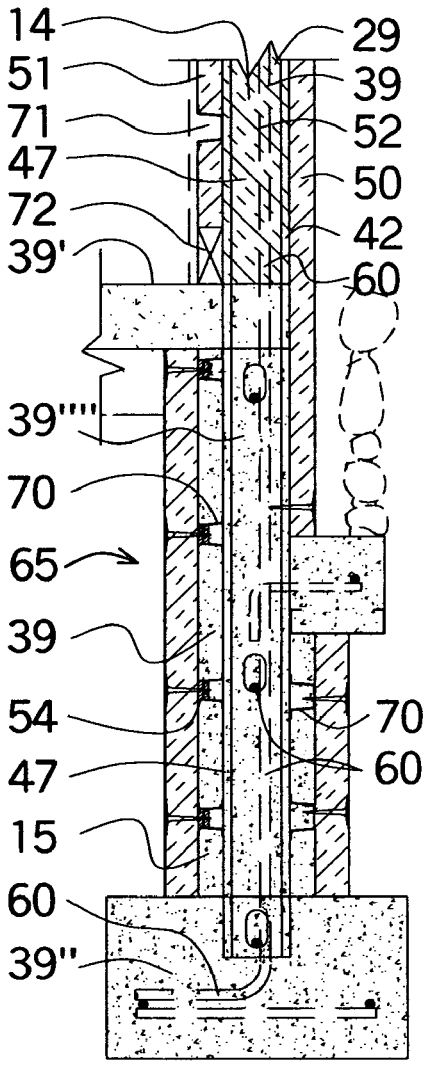
FIG. 16 is a wall section showing how a column forming structure can penetrate into a building footing.
Figure 17:
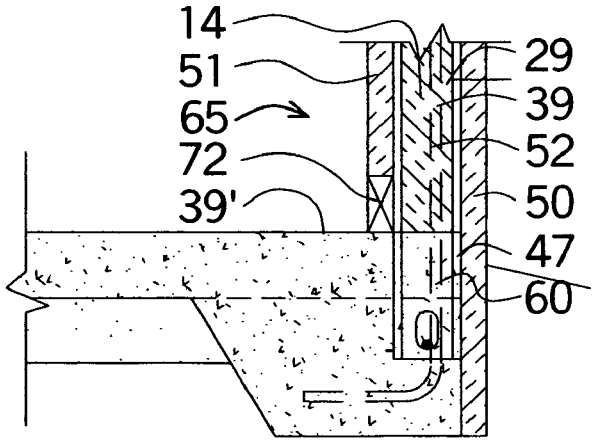
FIG. 17 is a wall section showing the column forming structure is secured within the concrete slab.
Figure 24:
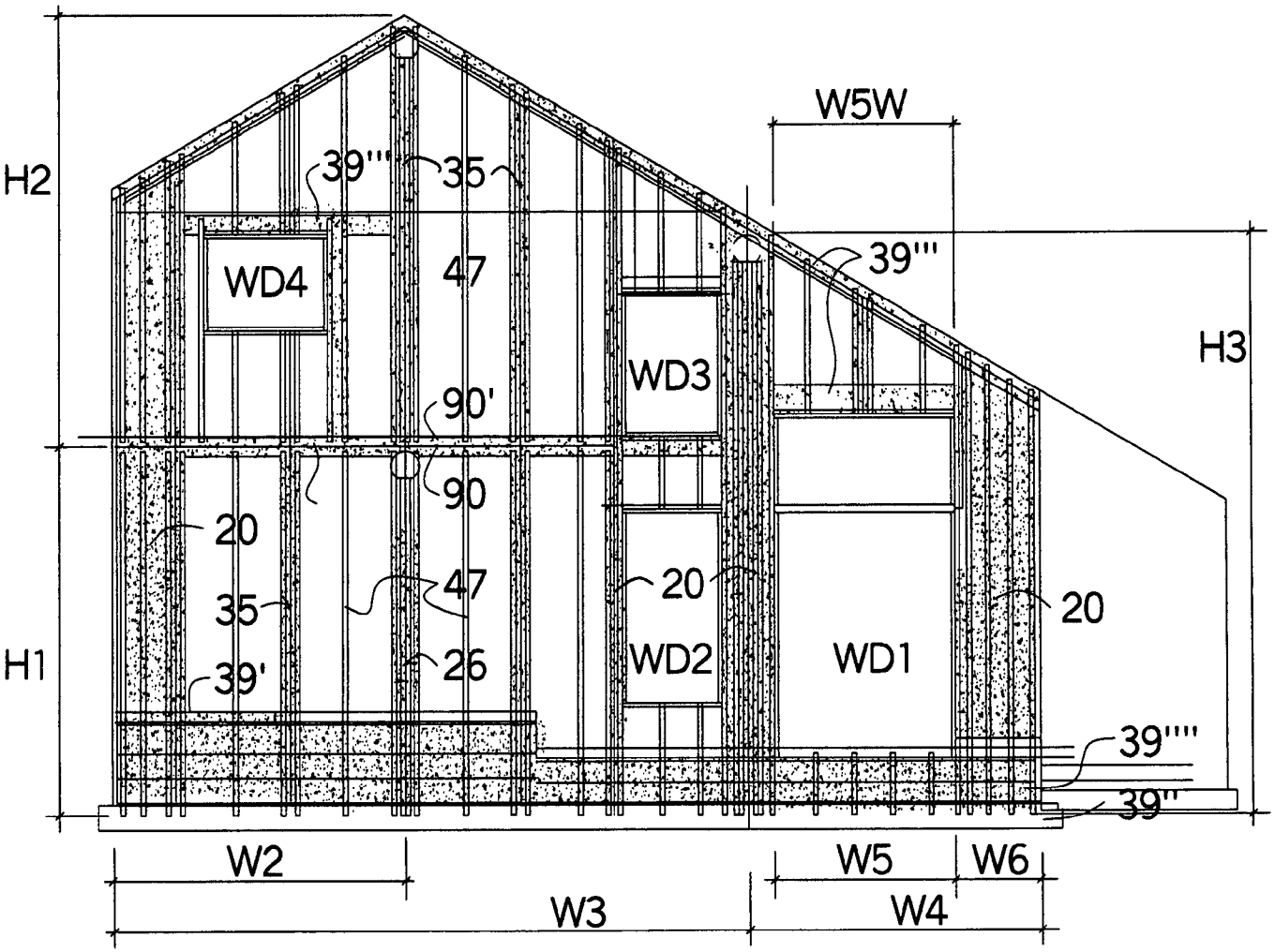
FIG. 24 shows the wall forming structure for a building where and enlarged column is used to support a beam, an L shaped column at the end of the wall and how the column at a window is incorporating within the building molds.

In FIG. 16 shows a vertical wall section A-A taken through FIG. 15 however any one of the previously mentioned wall molds could be used or in this case a concrete foundation 39"" is installed below the wall in FIG. 16 and a concrete floor 39' is shown in FIG. 17. The wall sections are taken through the middle of the wall mold rather than at the column molds. The wall panel 65 in FIG. 16 is shown with the spacer channel 47 extending from the concrete footing 39" through the concrete foundation 39"" into the wall mold 14. In FIG. 24 the wall molds are shown as large panels where a foundation can be incorporated into the wall panel. The upper section of the wall molds 14 as shown in FIGS. 16 & 17 are shown with the rigid board 50 and rigid insulation 51 as the outer surfaces along with the spacer insulation 52. If the wall section A-A were taken through the column mold 20 in both FIGS. 16 & 17, concrete 39 would be shown rather than the spacer insulation 52 and reinforcing steel 60 would be installed within the column mold 20. Below the concrete floor 39' is a foundation mold 15 that has hat channels 70 attached to the C channel 42 and a rigid board 50 and rigid insulation 51 are attached to the hat channel 70. The foundation mold 15 is described more fully in US 2007/0044392 by LeBlang. Another hat channel 70 is shown with a foam material 54 attached on the interior side of the hat channel 70. The foam material 54 seals the fastener 37 from any water penetrating through the concrete foundation 39"" as well as from the hat channel 70. The foam material 54 shown on the interior of the hat channel 70 allows additional fasteners (not shown) to be attached to drywall (not shown) to be attached to the concrete foundation 39'''. The column mold support shown as the C channel 42 is located within the column mold 20, passes through a foundation mold 15 and then into a concrete footing 39". Therefore the wall panel 65 when installed into a vertical position, will consist of the wall mold 14 plus a foundation mold 15 and the C channel 42, however only the C channel 42 extends through the wall mold 14 and the foundation mold 15 then into the concrete footing 39". The wall mold 14 is also showing a reverse hat channel 71 which is used to secure the rigid insulation 51 or as a horizontal or vertical electrical chase. In addition wood blocking 72 is installed on wall mold 14 for decorative trim base (not shown) can be installed after drywall (shown in ghost) is installed. The wood blocking 72 is also used as a horizontal connection between adjacent wall panels 65 as well as the reverse hat channel 71 and the hat channels 70 used in the foundation mold 15.

FIG. 17 shows the wall panel 65 and the same wall mold as shown in FIG. 15, except here the support channel shown as C channel 42 and spacer channel 47 are longer and extend into a concrete floor 39'. The rigid board 50 is shown extending to the bottom of the concrete floor 39' defining the edge of the concrete floor 39'. As mentioned in FIG. 16 if the wall section A-A where take through the column mold 20 the steel reinforcing 60 would extend from the column mold 20 into the concrete floor 39'.

Figure 18:
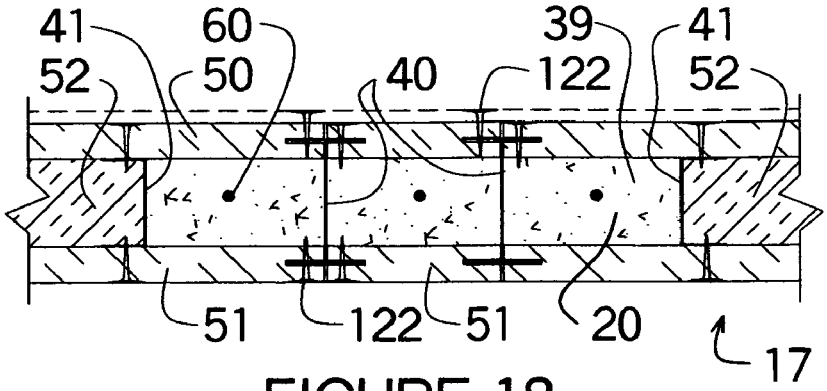
FIG. 18 is a plan view showing and elongated column with the column forming structure embedded within the exterior and interior wall mold structure.

FIG. 18 is similar to FIG. 14, in that the wall mold 17 consists of a rigid board 50 and rigid insulation 51 as the outer surfaces of column mold 20 and the U channels 41 form the opposite sides of column mold 20. The flanges 40*b* of the H channel 40 are shown in the middle of the rigid board 50 and rigid insulation 51 as well as between the H channels 40. The rigid board 50 and rigid insulation 51 can each be attached to the H channel 40 by screws 122. Depending on the size of the column mold 20 additional H channels 40 along with additional rigid board 50 and rigid insulation 51' can be installed between the H channels 40 forming a longer column mold 20.

Figure 19:
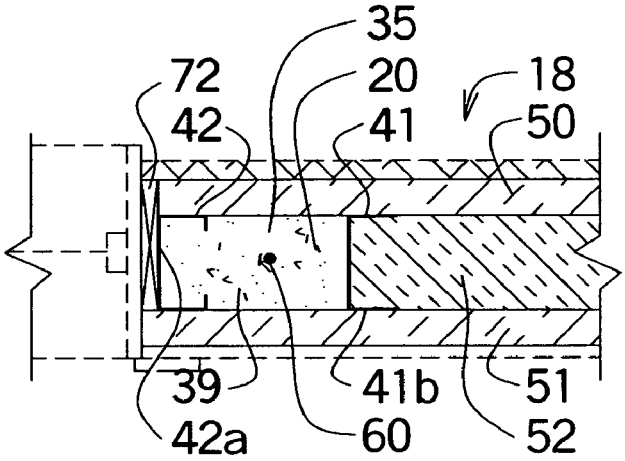
FIG. 19 is a plan view at a window showing the wall forming structure securing the window framing to the wall forming structure.

FIG. 19 shows a wall mold 18 which consists of a rigid board 50 and rigid insulation 51 as the outer surfaces along with the spacer insulation 52 between plus a column mold 20. The column mold structure in column mold 20 is shown with a U channel 41 with its flanges 41*b* encasing the end of the spacer insulation 52 and wood blocking 72 is attached to the web 42*a* of the C channel 42. The wood blocking 72 is used to attach a door or window (shown in ghost) to the wood blocking 72. Additional steel reinforcing 60 is added prior placing the wall mold 18 vertically and then pouring of concrete 39 into the column mold 20. Many of the previously described column mold structures can be used to attach wood blocking 72 to form a door or window at the concrete column 35.

Figure 20:
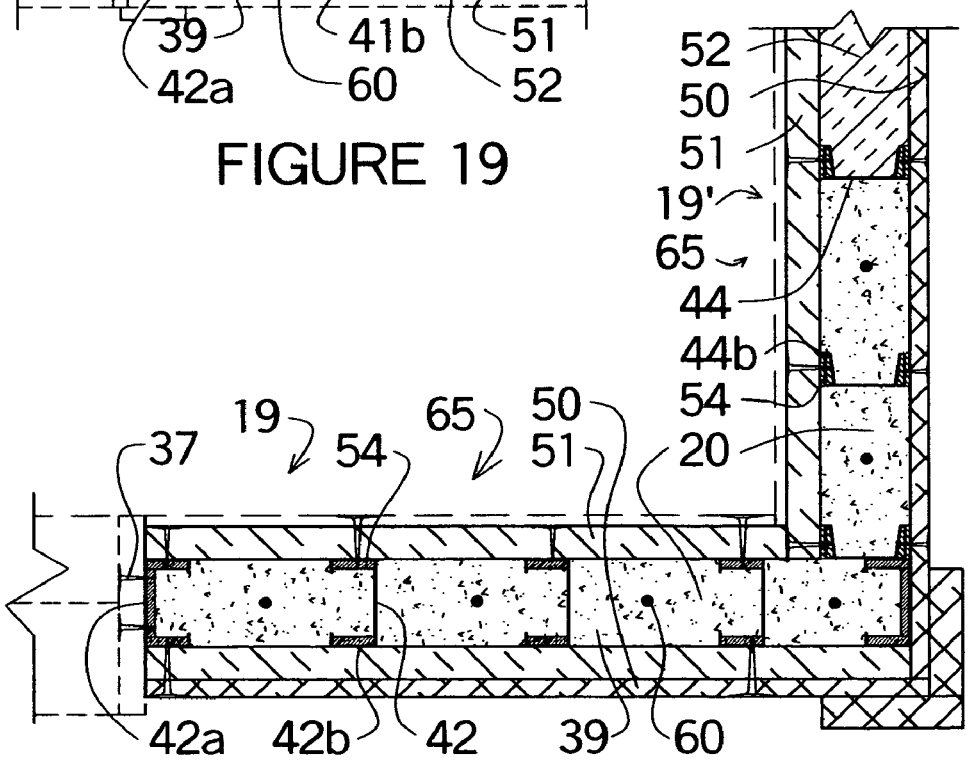
FIG. 20 is a plan view of a corner forming structure showing a L shaped column.

FIG. 20 shows two wall panels 65 intersecting at a corner forming an column mold 20 that is L shaped. The wall panel 65 in wall mold 19 consists of a rigid board 50 and rigid insulation 51 as the outer surfaces of wall panel 65 and an array of C channels 42 with the foam material 54 applied on the flanges 42*b* of the C channels. A door (shown in ghost) has the foam material 54 shown on the interior side of web 42*a* of the C channel 42 so the door (shown in ghost) can be attached to the wall panel 65 after the concrete 39 has cured. No wood blocking 72 is needed to secure the door (shown in ghost) as shown in FIG. 19 since the foam material 54 allows a fastener 37 to be installed directly into the web 42*a* without having to penetrate the concrete 39 as shown in FIG. 19. The wall mold 19' consists of a rigid board 50 and rigid insulation 51 as the outer surfaces of wall panel 65 and the column forming structure consists of an array of bent flange channels 44 with foam material 54*b* installed at the flanges 44*b*, as described in FIG. 14, plus the spacer insulation 52 installed within the wall mold 19'. The column mold 20 is partially formed in wall mold 19, and partially formed in wall mold 19'. When the wall mold 19 & 19' are installed vertically and connected together, column mold 20 is formed. Additional steel reinforcing 60 is installed within the column mold 20 and concrete 39 is installed when the walls are erected in a vertical position creating an L shaped column. Typically the column mold 20 would be used when two walls molds intersect at 90 degrees or at any angle. The elongated column mold 20 at the corner of a building has the integrity of a solid concrete wall or shear wall (more commonly used like diagonal bracing for wind shear), but in not a solid concrete wall since the spacer insulation 52 separates each concrete column 35 within a building structure. The only connection between each column mold 20 is a concrete beam discussed in FIG. 21 and other drawings.

Figure 21:
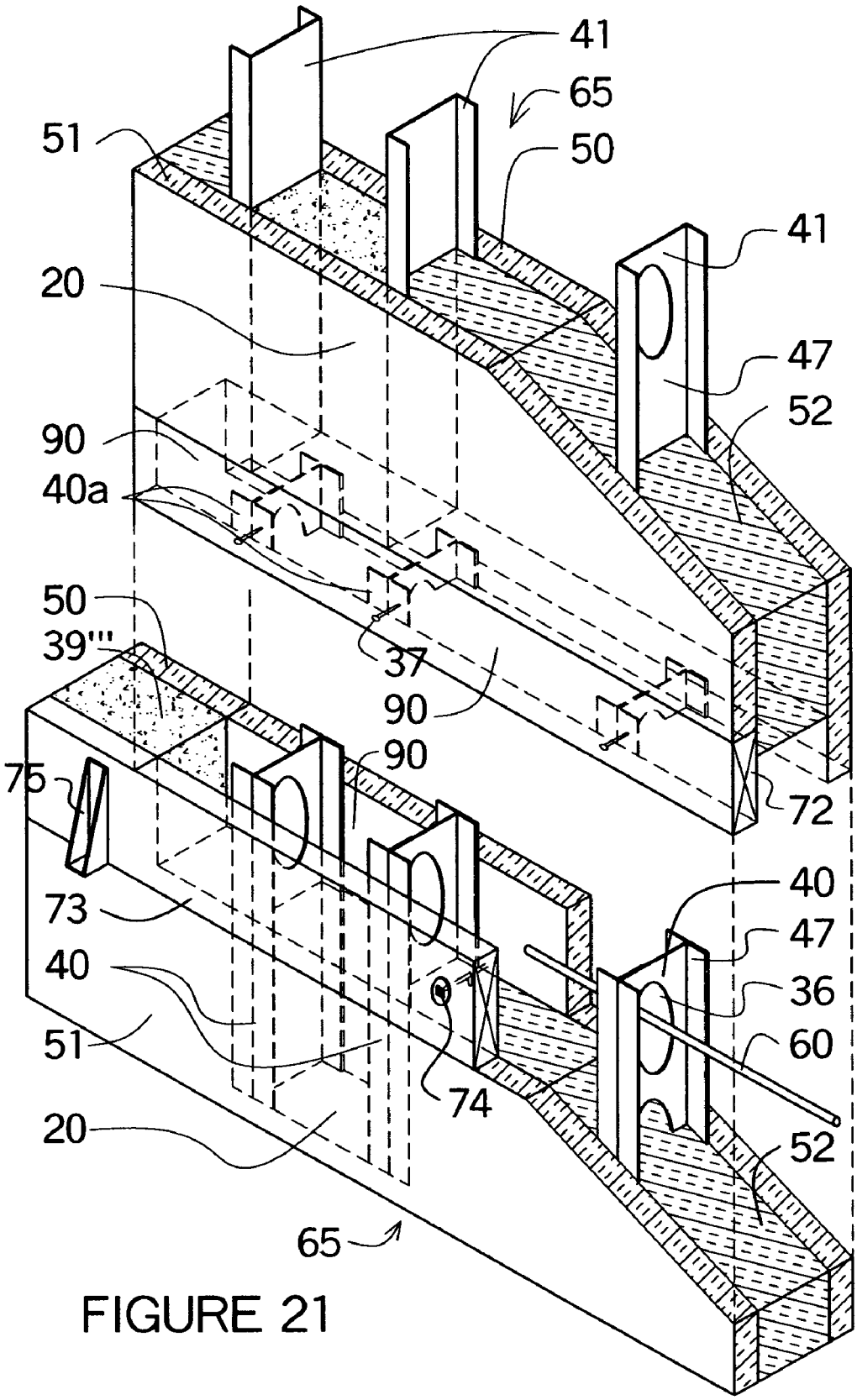
FIG. 21 is an isometric view of horizontal beam, column and another wall forming structure interlocking between each other.
Figure 23:
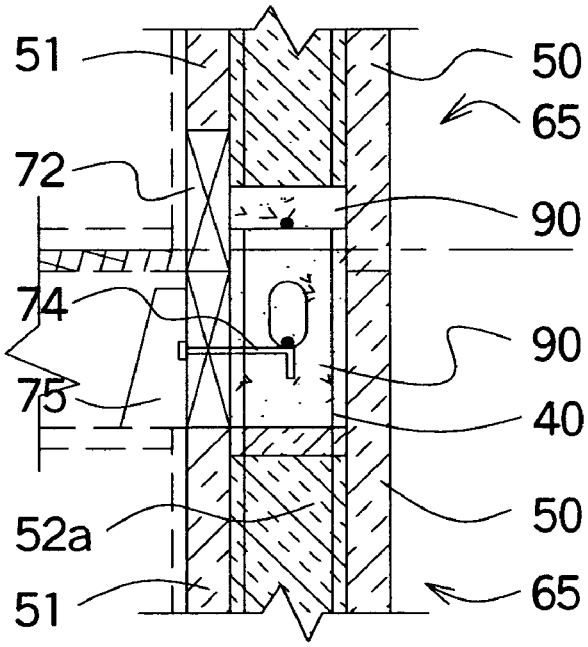
FIG. 23 shows a wall section where the horizontal beam intersects a floor as well as another wall panel above.

FIG. 21 is an isometric view and FIG. 23 is a wall section both drawings show two wall panels 65 that is wall panel 65 is installed above another wall panel 65. Both wall panels 65 consist of a rigid board 50 and rigid insulation 51 along with the spacer insulation 52 between the outer surfaces. The wall panel 65 is shown with a column mold 20 and horizontal beam mold 90 intersecting at the top of wall panel 65. In wall panel 65, the spacer insulation 52 is shown stopping at the bottom of the beam mold 90. The wall panel support channel shown as an H channel 40 forms column mold 20 then passes through the beam mold 90 then extending above the wall panel 65. The extension above the lower wall panel 65 is shown in ghost in the wall panel 65 and when wall panel 65 is resting above the lower wall panel 65 fasteners (not shown) connect the rigid board 50 and rigid insulation 51 to the H channels 40 of wall panel 65. Horizontal steel reinforcing 60 can be installed through the holes 36 in the H channel 40 at the beam mold 90 and at the spacer channel 47 of the beam mold 90. The wall panel 65 is shown with U channels 41 as supports for the column mold 20 and is used as an spacer channel 47 in the middle of the spacer insulation 52. The U channels are shown shorter at wall panel 65 above in order to allow for the column mold supports of H channels 40 to be secured with fasteners 37 through the rigid board 50 and rigid insulation 51 thereby connecting the two wall panels 65 together. The column mold 20 can be filled with concrete 39 prior to wall panels 65 being installed. The beam mold 90 can be filled with concrete 39 at the same time as the column mold 20 or the beam mold 90 can be filled with concrete 39 when the column mold 20 is filled with concrete 39. In wall panel 65, a wood ledger 73 is attached directly to the H channels 40 within the column mold 20 and the spacer channel 47. Anchor bolts 74 are attached directly to the wood ledger 73 and placed within the beam mold 90. The metal joist hanger 75 is attached to the wood ledger 73. A similar light gauge metal joist and metal ledger joist (not shown) can also be in lieu of the wood ledger. Another added feature, is to install wood blocking 72 at a floor line or where horizontal support is required between panels as shown in wall panel 65.

Figure 22:
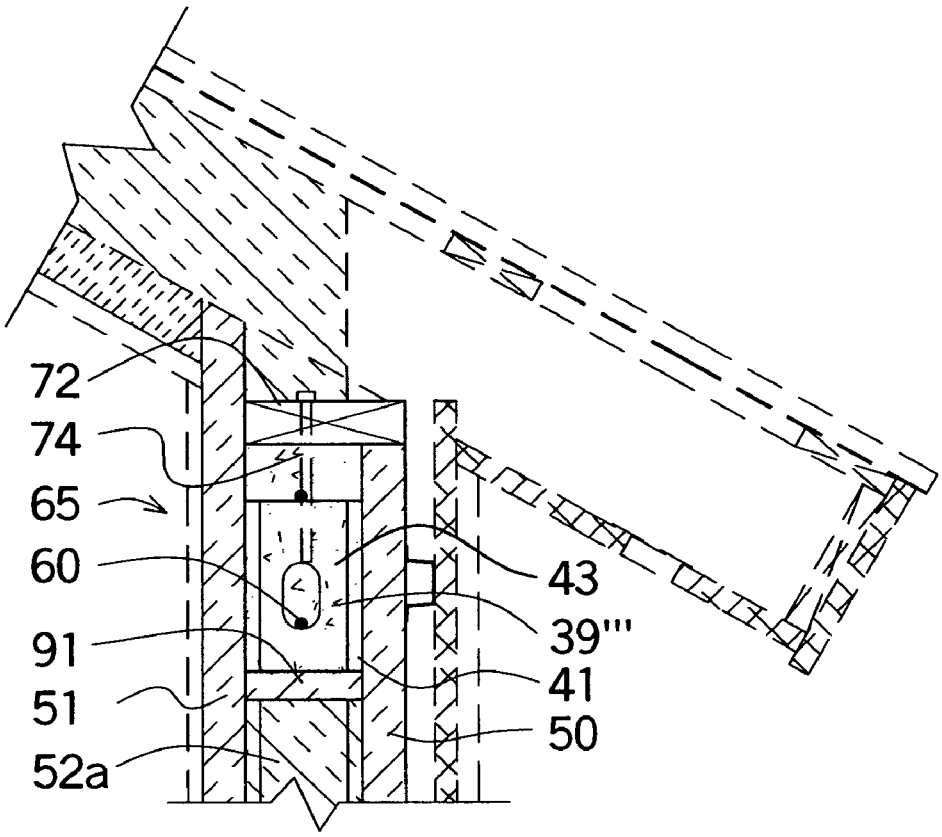
FIG. 22 shows a roof intersection the wall forming mold at a horizontal beam.

FIG. 23 shows a wall section of the beam mold 90 of the two wall panels 65 shown in FIG. 21. The wall section is shown at the beam mold 90 wherein the spacer channels 47 are shown as H channels 40 extend above the spacer insulation 52 into beam mold 90 as well as the H channels 40 from the column mold 20. The rigid board 50 extends on the outside of the two wall panels 65. The spacer insulation 52 as described previously is not shown the lower wall panel 65 instead loose granular insulation 52*a* as shown in FIG. 4 is installed between the rigid insulation 51 and the rigid board 50 to the bottom of beam mold 90. The wood ledger 73, anchor bolt 74 and metal joist hanger 75 are used in the beam mold 90 as discussed in FIG. 22. On the other hand, FIG. 22 shows an extension of the wall panel 65 from FIG. 23, however the panel mold 65 is formed differently, that is loose granular insulation 52*a* as shown in FIG. 4 is installed between the rigid insulation and the rigid board 50 to the bottom of the beam mold 90. A horizontal baffle board 91 is shown at the bottom of the beam mold 90 and is used when loose granular insulation 52*a* is used in lieu of the spacer insulation 52 to support the weight of concrete 39 within the beam mold 90. Wood blocking 72 can be installed at the top of the wall panel 65 to connect to the wood roof joists (shown in ghost). An anchor bolt 74 connects the wood blocking directly into the concrete 39 within the beam mold 90.

FIG. 24 shows a panel diagram of a building elevation using many of the previously described column and beam molds as well as the wall panels. When constructing a building using wall panels, each wall panel requires a different number even though the wall panels are a variation of the previously described wall panels 65. The wall panels shown in this drawing can be as narrow as 4'-0" wide shown as W1 to intermediate panel widths shown as W2 to full width walls shown as W3. The height H1 of any of the W1, W2 or W3 wall panels could be from the footing 39", including the concrete foundation 39"" to the beam mold 90 at the second floor. Wall panels are sometimes manufactured from column centerlines or from large window jambs depending on the size of the windows. The wall panel W4 is shown in the middle of column mold 20 to the end of the wall mold 32 and extending from the footing 39", including the foundation 39'" to the roof referring to height H3. On the other hand, smaller sections like a foundation wall panel W5 is easier to handle without using a crane (not shown) to install the foundation wall panel W5. Another example would be wall panel W6 as part of an L column mold 20 or a window header mold W5W which incorporated a concrete beam 39'" at the roof line as well as above the door/window WD1. The interlocking panel connection shown in FIG. 21 is shown at the beam molds 90. On the other hand, the wall panel W2 could be two stories high by making the panel heights H1 and H2 as all one panel height. This particular building showed the concrete columns 35 close together, therefore there are not many spacer channels 47. The column mold 20 is shown wider as it depends on the spacing between window/door WD1 & WD2 as well as any floor or roof beams that would affect the size of the column mold 20. For example, the column mold 20 is shown in FIG. 20 as an L shape is used on the right side of the building along with the window detail shown in the same drawing. Another column mold 20 is shown on the left corner of the building that is also L shaped, however the size and number of column support members is less than on the right side. A column mold 20 is shown next to a window WD2 and is a wider column mold. Since a concrete beam 39'" is located between the building floors above, a window header like a concrete beam 39'" is not required.

Figure 25:
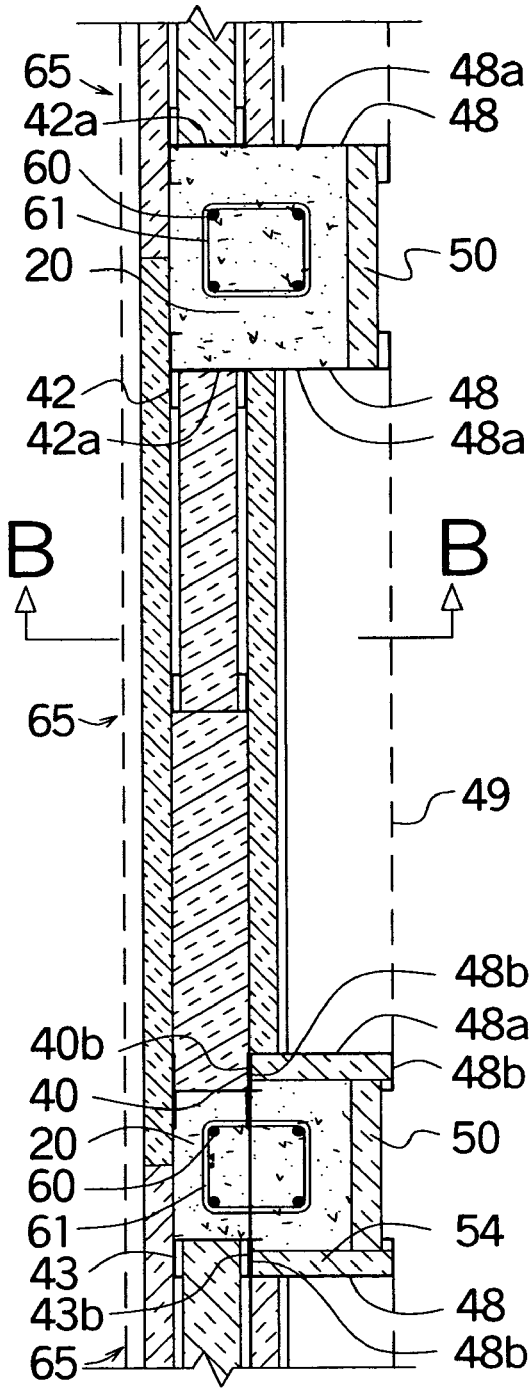
FIG. 25 shows a wall column protruding outside the limits of the wall framing structure.

FIG. 25 shows three wall panels 65 similar to the wall panels shown in FIG. 15, however the column molds 20 are wider than the wall panels 65 between the column molds 20. Column mold 20 shows the same column mold structure of a C channel 42 in one wall panel 65 and an H channel 40 in the other wall panel 65 as shown in FIG. 15. A larger C channel 48 is shown protruding perpendicular to both the wall panels 65 and are connected to the flange 42*b* of the C channel 42 and to the flange 48*b* of the other larger C channel 48. The opposite side of the column mold 20 shows the flange 48*b* of the larger C channel 48 connecting to the flange 40*b* of the H channel 40. The web 48*a* of the large C channel 48 is shown with a foam material 54; however the foam material 54 is not really necessary unless drywall (not shown) is installed over the large C channel 48. Reinforcing steel 60 is installed within the column mold 20 and a steel stirrup 61 passes around the reinforcing steel 60. After the wall panels 65 are vertically into place, a rigid board 50 is installed at the opposite flange 48*b* of each of the large C channels 48 of the wall panels 65. The other column mold 20 shows another larger C channel 48 where the web 48*a* is attached to the web 42 of the C channel 42. The large C channel 48 can be attached to the wall panels 65 prior to the erection the wall panels or can be attached after the wall panels 65 have been erected. The rigid board 50 is installed between the webs 48*a* and connected to the flanges 48*b* after the reinforcing steel 60 and steel stirrups 61 have been installed.

Figure 26:
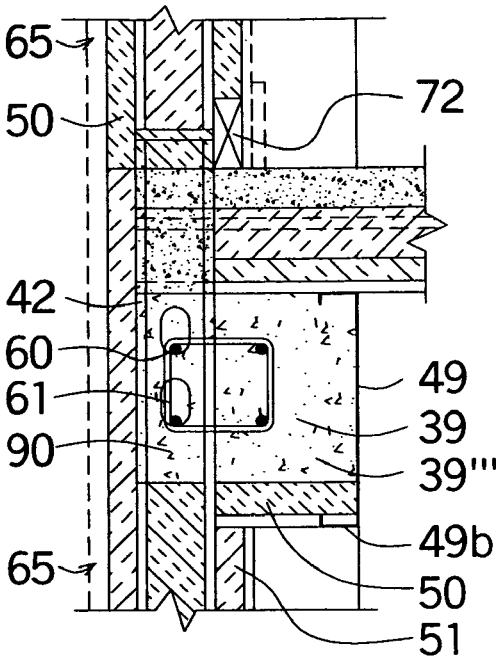
FIG. 26 shows a horizontal beam protruding outside the limits of the wall framing structure.

FIG. 26 is a wall section B-B taken through wall panel 65 in FIG. 25. The wall section B-B is similar to the wall section A-A shown in FIG. 23, except here the beam mold 90 is wider and overhangs the wall panel 65. A beam support channel 49 is shown dashed in the plan view of FIG. 25 and is supported by the larger C channel 48 of the column molds 20. Horizontal reinforcing steel 60 is installed in the beam mold 90 and steel stirrups 61 are installed around the reinforcing steel 60. A rigid board 50 is placed on the flange 49*b* of the beam support channel 49 and on the rigid insulation 51 of the wall panels 65. Concrete 39 can now be installed within the beam mold 90 after the wall panel 65 is installed vertical to the height of the beam support channel 49. A steel and rigid flooring system described in a previous patent pending by LeBlang is shown resting on the concrete beam 39'''. The spacer channel 47 shown as C channel 42 extends through the beam mold 90 and past the rigid floor system mentioned earlier and similar to channels extending into the wall above as shown in FIG. 21. The concrete 39 can be poured over the rigid floor system as well as between the C channels 42. After the rigid floor system is complete another wall panel 65 can be placed above the wall panel 65 and attached at the rigid board 50 and at the wood blocking 72.

Figure 27:
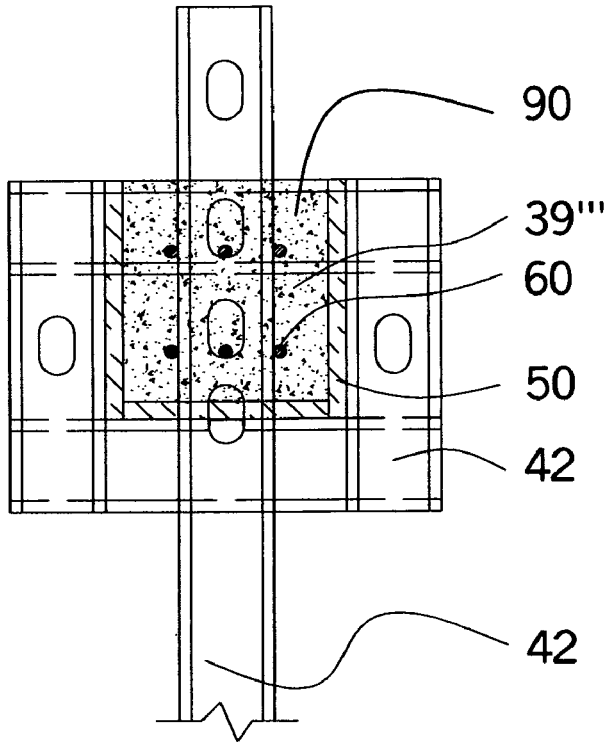
FIG. 27 shows a horizontal beam being temporarily supported by an interior framing wall structure.
Figure 28:
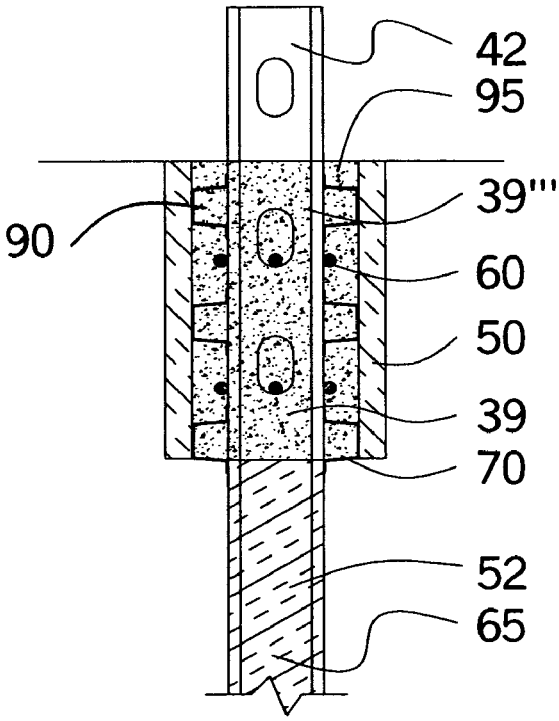
FIG. 28 shows another horizontal beam being temporarily supported by an interior framing wall structure.

In FIG. 27 and FIG. 28 show two interior wall sections where a non-load bearing wall channel shows a C channel 42 is used to support a beam molds 90. Another C channel 42 is used to frame the beam mold 90 by using C channels 42 to form the beam mold 90. A rigid board 50 is installed at the interior of the 90 leaving the C channels 42 exposed for utility access around the concrete beam 39'''. The C channel 42 extends above the concrete beam 39''' in order for a flooring system shown in FIG. 26 to be securely fastened to the interior wall C channel 42. In FIG. 28 the wall section shows a concrete beam 39''', which is narrower and being supported by the C channel 42. An array of hat channels 70 is secured to the C channels 42 and a rigid board 50 is secured to the hat channel 70. The wall panel 65 in FIG. 28 shows another interior beam mold 90, which is shown with spacer insulation 52 between the C channel 42 and the spacer insulation 52 is used to support the concrete 39 within the beam mold 90.

Figure 29:
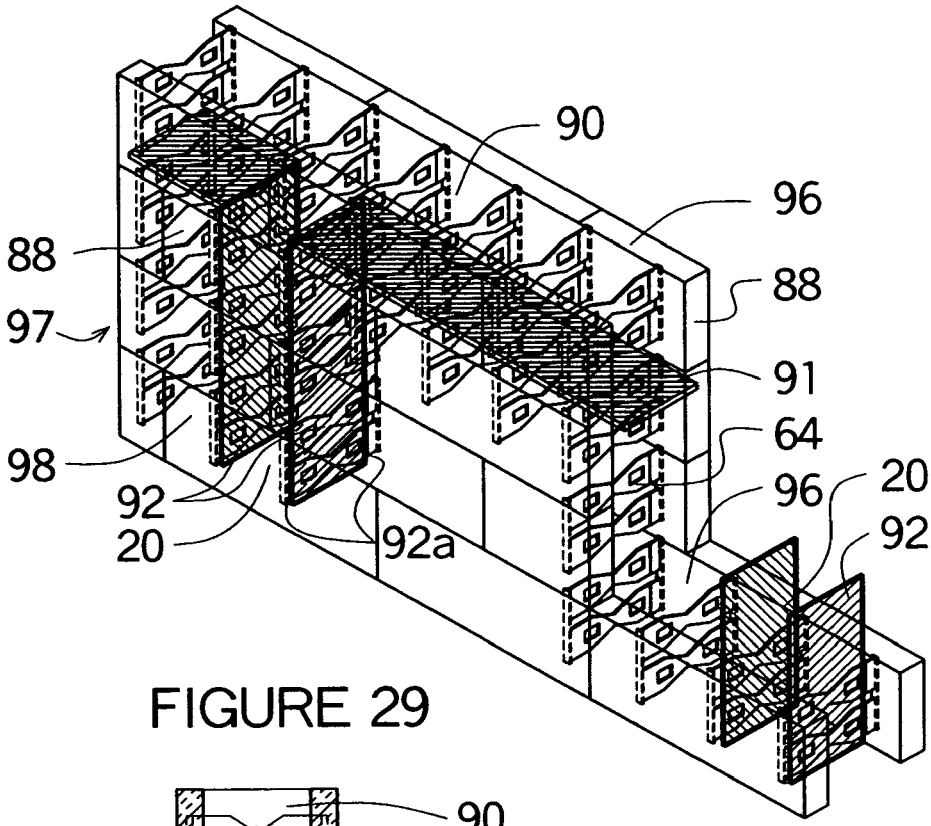
FIG. 29 is an isometric view of a typical ICF wall forming structure incorporating a baffle system for installing a column and a beam within a ICF building block.
Figure 30:
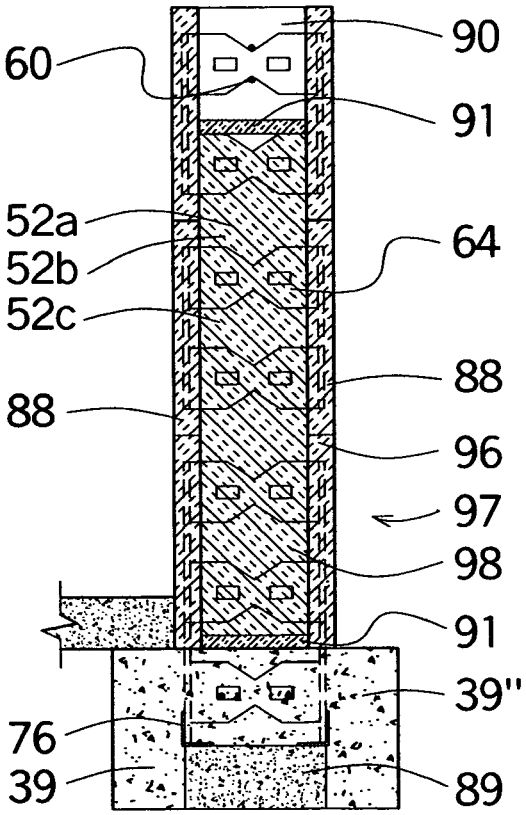
FIG. 30 is a wall section of an ICF wall showing the baffles for installing a beam and column within the ICF wall blocks.

FIG. 29 is an isometric view of one of the many ICF's (Insulating Concrete Forms) that are presently used in the construction industry. There are many different patents concerning various types of connectors used to form an ICF and FIG. 29 & FIG. 30 shows one of those connectors 64. The connectors 64 connect the rigid foam block faces 88 located on both sides of an ICF block mold 96 forming a cavity 98 between the rigid foam block faces 88. The ICF block molds 96 are placed adjacent and above each other forming a wall mold 97. The connectors 64 come in a variety of shapes and are installed in a variety of ways, however all these connectors have holes within the connectors and/or spaces between the connectors to allow concrete 39 to flow horizontally between the connectors 64 forming a concrete wall between the rigid foam block faces 88 as well as to the top of the ICF block molds 96. In lieu of filling the entire cavity 98 with concrete 39 in a typical ICF, this pending application shows a horizontal baffle 91 and a vertical baffle 92 installed within the cavity 98 forming a column mold 20 and beam mold 90. A vertical baffle 92 is installed adjacent to the connectors 64 and located on both sides of the column mold 20. The baffles 92 can be made of solid foam, plastic or metal so the baffle edge 92*a* fits snuggly against the rigid foam block faces 88 and against the connectors 64. Fasteners (not shown) connect the connectors 64 to the baffles 92. As described in FIG. 4 where the spacer insulation 52 was not used, a loose granular insulation material 52*a* can be poured into the cavity 98 through the top of the wall mold 97. In addition, in lieu of a loose granular insulation 52*a*, a dry cellulose fiber insulation 52*b* or a liquid foam 52*c* can also be filled from the top of the wall mold 97. After the cavity 98 is filled with either of the insulation materials 52*a*, 52*b* or 52*c*, a horizontal baffle 91 can be installed over the insulation materials 52*a*, 52*b* or 52*c* and on top of the exposed connector 64. The width of the column mold 20 is determined by the size of the connector 64 between the rigid foam block faces 88 and the length is corresponds to the number of connectors 64 one desires to have in the middle to form the column mold 20. The width of the beam mold 90 is determined by the size of the connector 64 between the rigid foam block faces 88 and the height is determined by the location of the horizontal baffle 91 within the wall mold 97. FIG. 30 also shows the connector 64 extending below the rigid foam block faces 88 and extending into a concrete footing 39". Since individual ICF block molds 96 are not well connected horizontally between each other, an angle 76 is shown connecting the connector 64 as well as supported by a concrete block spacer 89 until the concrete 39 is poured into the concrete footing 39". The angle 76 shown in FIG. 30 allow the connectors 64 to be connected together to form a wall panel 65 by connecting the ICF block molds 96.

Figure 31:
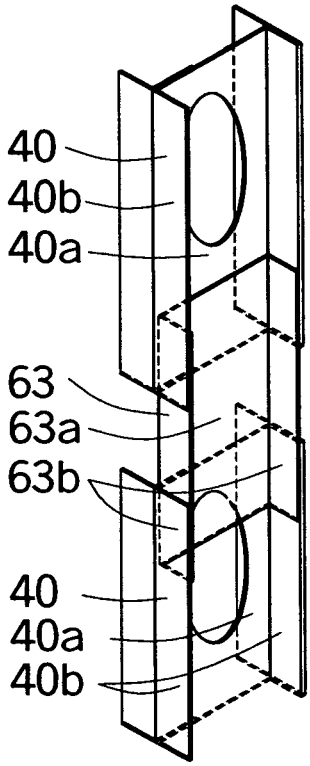
FIG. 31 shows a coupling used to fasten one column forming structure to another column forming structure.

FIG. 31 shows and isometric drawing of H channels 40 with a coupling 63 connecting the two H channels 40 together. The coupling 63 can be used on any of the support channels, but more specifically shown is the H channels 40. The coupling 63 is shown connecting to the webs 40*a* to the web 63*a*, as well as the flanges 40*b* being connected to the flanges 63*b* of the coupling 63. When a column forming structure or interior channel as described earlier is not long enough for a wall panel, a coupling 63 can be used to connect two channels together.

Figure 32:
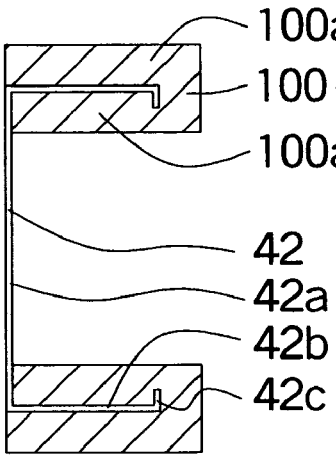
FIG. 32 shows a C channel with the foam material wrapped around the flange of the C channel.
Figure 33:
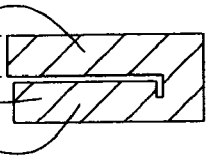
FIG. 33 shows the foam material configuration for the C channel.

In FIG. 32 shows a cross section of a C channel 42 with a different insulating foam 100 wrapped around the flange 42*b* of the C channel 42, and shown in FIGS. 10 & 11 as well as in some of the previous wall mold applications. The insulating foam 100 has a thickness t which is constant as it wraps around the flange 42*b*. The C channel 42 also has a lip 42*c* at the end of the flange 42*b*. The insulating foam 100 extends the length of the flange 42*b* shown as 100*a*, then around the lip 42*c* over the back side of the flange 42*b* shown as 100*a*' and stops at the web 42*a*. The lip 42*c* and the friction of the flange 42*b* allows the insulating foam 100 to adhere to the C channel 42. The insulating foam 100 is shown in FIG. 33 after a hot knife (not shown) has cut the groove into the insulating foam 100 for the C channel 42 configuration.

Figure 35:
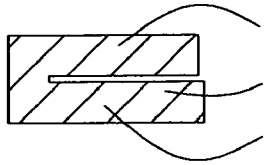
FIG. 35 shows the foam material configuration of the double flange channel.
Figure 34:
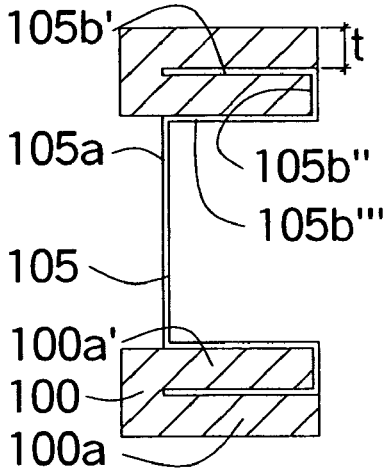
FIG. 34 shows a double flange channel with the foam material inserted into the double flange channel

FIG. 34 shows a double flange channel 105, which is another type of support channel to form column molds 20 and beam molds 90 that consist of a web 105*a* and two bent flanges 105*b*' & 105*b*''', one at each end of the web 105*a*. The bent flanges show an outer flange 105*b*', a turning flange 105*b*", and a returning flange 105*b*'''; which are connected to the web 105*a* of the bent channel 105. The bent flanges allows a fastener (not shown) to be connected to two flanges, the outer flange 105*b*' and the inner flange 105*b*". These double flanges 105*b*' & 105*b*''' gives the fastener 37 (not shown) twice the strength to support the rigid board 50 or rigid insulation 51 from the pressure of the concrete 39 shown in any of the previously mention Figures. Also shown in FIG. 34 is insulating foam 100 that is wrapped around the bent flange 105*b*. The insulating foam 100 extends the length of the flange 105*b*''' shown as 100*a*, then around the turning flange 105" over the back side of the returning flange 105*b*''' shown as 100*a*' and stops at the web 105*a*. The friction between the outer flange 105*b*' and the returning flange 105*b*''' is sufficient to hold the insulating foam 100 into place. The insulating foam 100 as shown in FIG. 35 can also be used on U channels or on H channels previously described.

Figure 36:
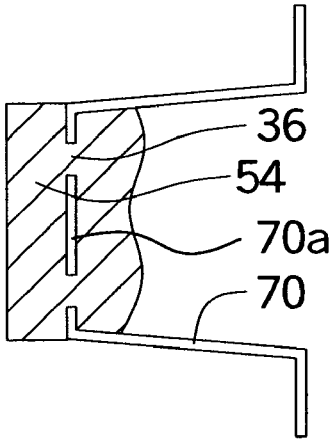
FIG. 36 shows the foam material on both sides of the hat channel.

FIG. 36 shows a cross-section of the insulating foam 100 installed on a hat channel 86. The foam material 54 can be installed using the same method as described in FIG. 11, that is applying holes 36 on the face 70*a* of the hat channel 70 and then applying the foam material 54 into the holes 36 and then further removing the residual with a hot knife (not shown). The foam material 54 shown here has a thermal break at the flat edge of the foam material 54 as shown installed in similar FIGS. 13, 14 & 16.

Figure 37:
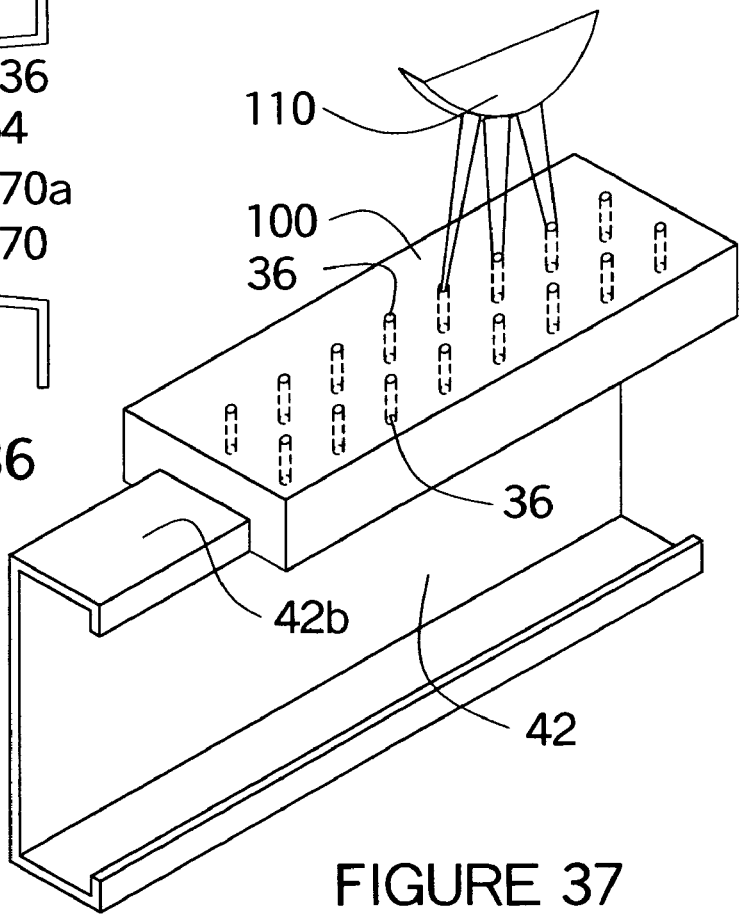
FIG. 37 shows the foam material wrapping the flange of the C channels and punch holes through the insulating foam into the C channel flange.

The isometric drawing of FIG. 37 shows insulating foam 100 placed on the flange 42*b* of the C channel 42. A punch press or a roll punch 110 can make a hole 36 into the insulating foam 100 and then force the insulating foam 100 through the hole 36 in the flange 42*b* thereby attaching the insulating foam 100 to the C channel 42. The insulating foam 100 that passes through the hole 36 is enough to secure the insulating foam 100 to the flange 42*b* of the C channel 42.

Figure 38:
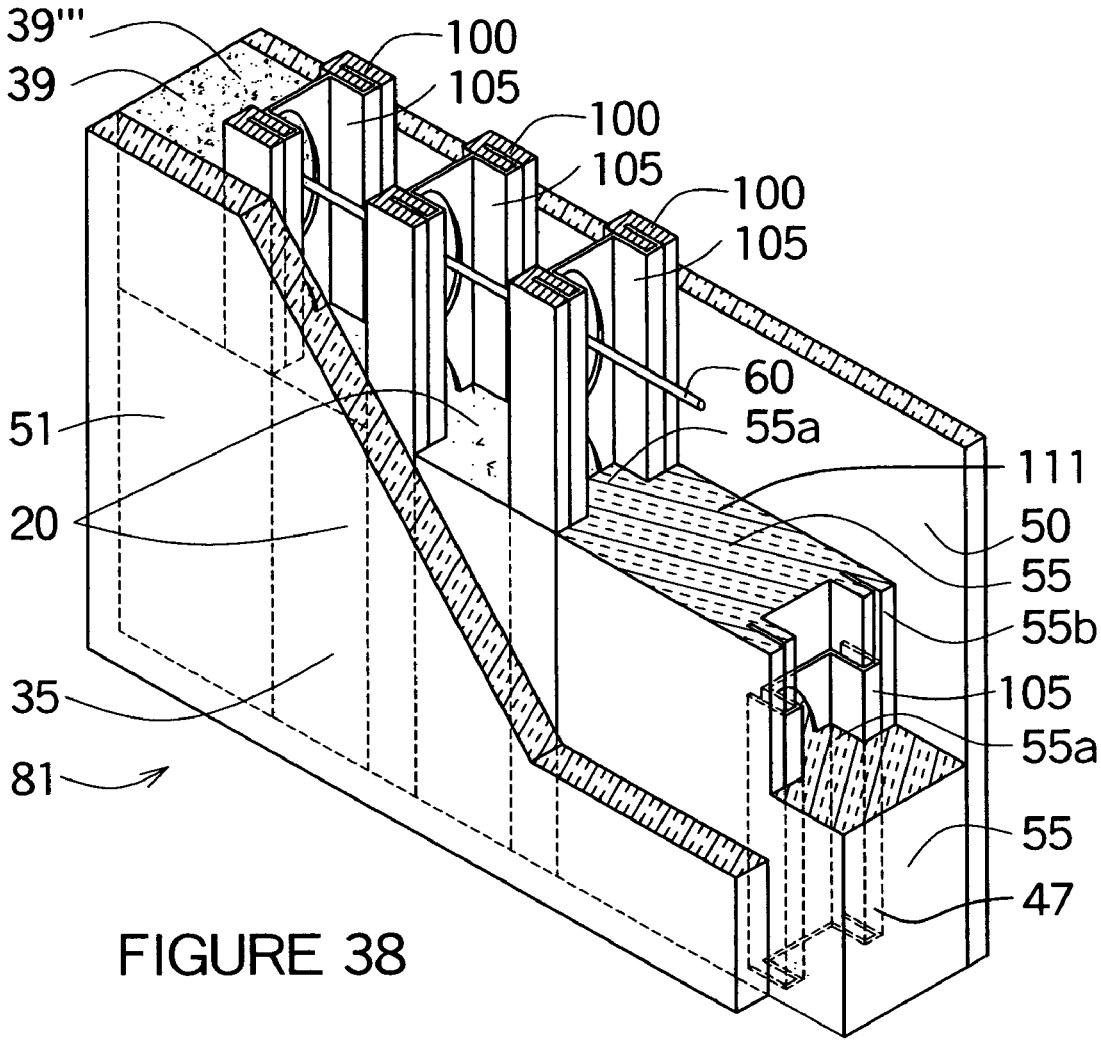
FIG. 38 shows an isometric drawing of the double flange channel with the column and beam in wall.
Figure 39:
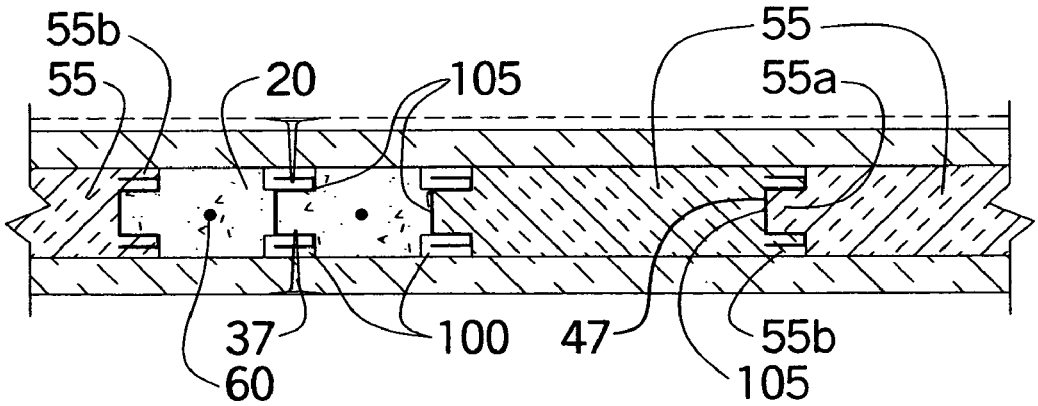
FIG. 39 shows a plan view of the double flange channel in the wall.
Figure 40:
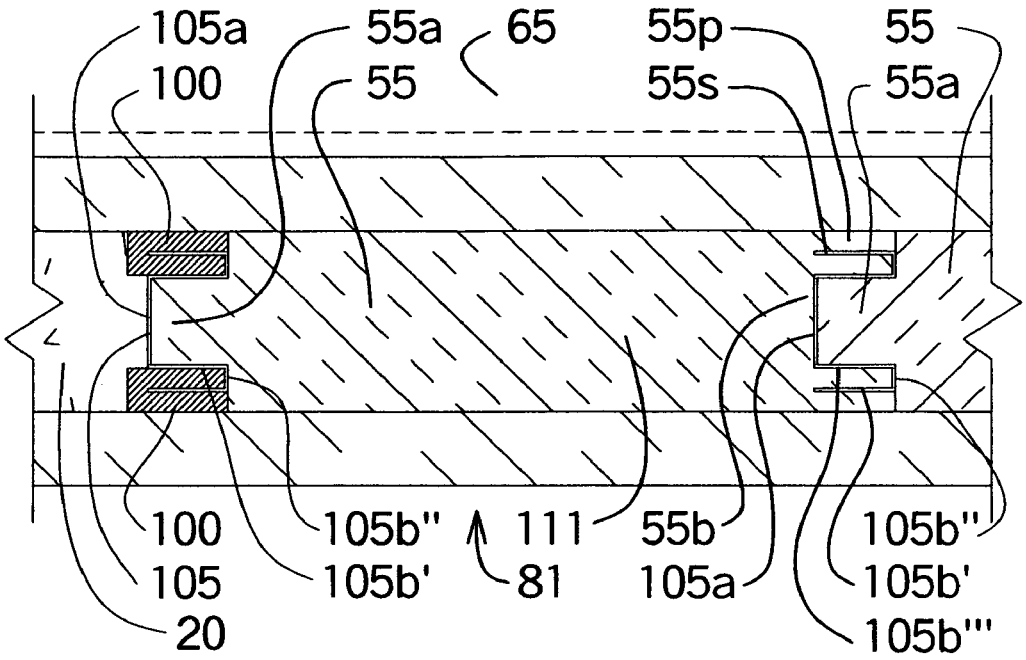
FIG. 40 shows an enlarge plan view of the double flange channel in wall.

FIGS. 38, 39 & 40 is a structural insulating core 111 that consists of foam spacers 55 and support channels within the foam spacers 55 with rigid board 50 and rigid insulation 51 installed over the structural insulating core 111. The foam spacers 55 wrap around the flanges 105*b*' & 105*b*' of the support channels and the webs 105*a* interlock between adjacent foam spacers 55. In addition, the flanges 105*b*' of the support channels fit into grooves 55*b* of foam spacer 55 and where the support channels are located within a column mold 20 or the spacer channels 47 within the foam spacers 55. More specifically the support channel of the column mold 20 forming structure is a double flange channel 105 and the interconnection between the foam spacers 55 and the insulating foam 100. FIG. 38 is showing the wall mold 81 consisting of the rigid board 50 and the rigid insulation 51 as the outer surfaces of wall mold 81. The structural insulating core 111 forming structure at the column mold 20 consists of three double flange channels 105, however only one double flange channels 105 on the right side of the column mold 20 has the insulating foam 100. The insulating foam 100 is wrapped around the flange 105*b*' of the double flange channel 105 and the isometric shows the insulating foam 100 is also attached to the double flange channel 105 above the foam spacers 55. The insulating foam 100 is shown attached to the outer flange 105*b*', and more clearly shown in FIG. 40. The foam spacer 55 is configured to have a tongue shape shown as 55*a* and a groove shape shown as 55*b*. The tongue shape 55*a* extends to the web 105*a* of the double flange channel 105 and has a depth of the inner flange 105*b*'''. The width of the foam spacer 55 extends from the outer edge of the insulating foam 100 on both sides of the double flange channel 105. The opposite side of the foam spacer 55 shows a double flange channel 105 between the foam spacers 55. The foam spacer 55 is shown abutting the double flange channel 105 and shown as 55*b* as the groove side of the foam spacer 55. The foam spacer 55 fits adjacent to the web 105*a* of the double flange channel 105 and extends to the turning flange 105*b*" to the edge of the projection 55*p* of the adjoining foam spacer 55. The groove shape 55*b* is configured so that the outer flange 105*b*' fits into a slot 55*s* within the projection 55*p* of the foam spacer 55. The adjacent foam spacer 55 is shown with the tongue shape 55*a* fitting securely against the web 105*a* of the double flange channel 105. The plan section of FIG. 40 shows the foam spacer 55 more clearly and shows the column mold 20. Where the column mold 20 occurs, the insulating foam 100 is required the full height of a concrete column 35. On the other hand, where foam spacer 55 is required at the opposite end of the column mold 20, a groove shape 55*b* is required to begin an array of foam spacer 55 and double flange channels 105 within the wall mold 81. In FIGS. 38 & 40 also show the double flange channel 105 being used as an spacer channel 47 like similarly shown in FIG. 15. The combination of the double flange channel 105 and the foam spacer 55 is another combination of the structural insulating core 111. The column molds 20 (only one shown) and beam mold 90 can be at any size depending on the structural requirements of the column and beam. The wall mold 81 can consist of several wall panels 65 between each column mold 20 and the beam mold 90 within the wall panels 65 connects to the column molds 20. Where a beam mold 90 occurs, the insulating foam 100 is installed on the double flange channel 105.

Figure 41:
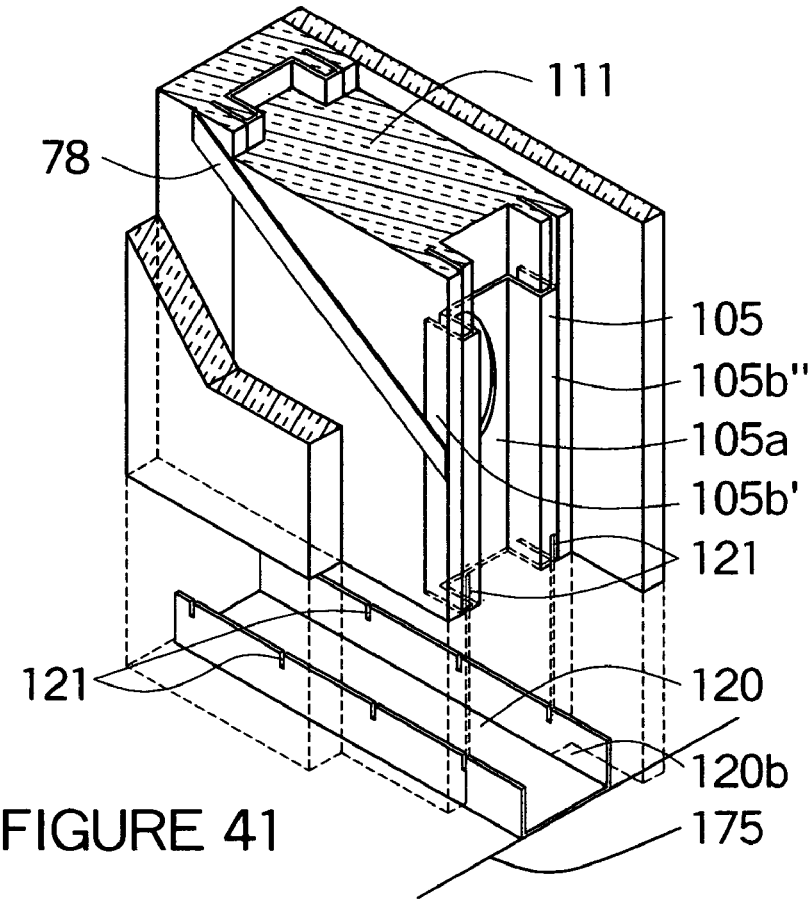
FIG. 41 shows the base plate at the floor when using the double flange channel.

FIG. 41 is an isometric view structural insulating core 111 showing the double flange channel 105 being attached to a standard base plate 120 used in light gauge metal framing. A base plate 120 is attached to the floor 175, and the double flange channel 105 is connected to the base plate 120. The base plate 120, however is different because the base plate 120 has a groove 121 cut in the flange 120*b* and another groove 121 in the double flange channel 105 at the returning flange 105*b*" and these grooves 121 are cut 16' & 24" OC in the base plate 120 in order to easily attached them together without measuring. Also the base plate 120 is larger than width of the web 105*a* of the double flange channel 105. The groove 121 is in the middle of the returning flange 105*b*" and corresponds to the groove 121 in the double flange channel 105 and the groove 121 in the foam spacer corresponding to the base plate 120. By having a larger base plate 120, the spacer insulation creates a thermal break between the flanges 105*b*' and 105*b*' of the double flange channel 105. Now only the grooves 121 come in contact with the turning flange 120*b*" of the base plate 120. In addition, diagonal bracing 78 is shown installed on the surface of the foam spacer 55 connecting the array of double flange channels 105.

Figure 42:
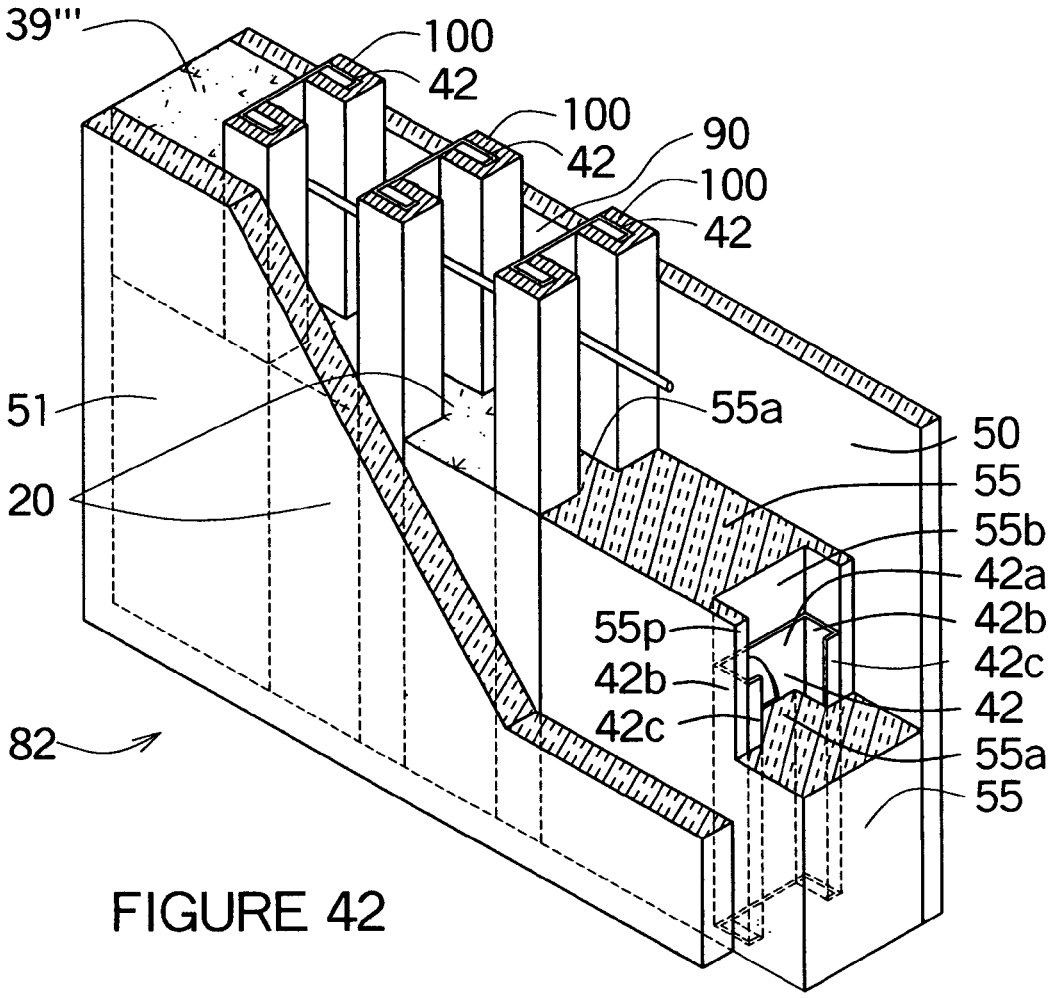
FIG. 42 shows an isometric drawing using a C channel as the wall forming structure.

FIG. 42 shows another structural insulating core similar to FIG. 38 except in FIG. 42 the support channels are shown as C channels 42 with insulating foam 100 secured around the flange 42 and the lip 42*c* when the C channels extend into the beam mold 90 supported by rigid board 50 and rigid insulation 51. The insulating foam 100 slides around the lip 42*c* making the insulating foam 100 easier to install around the C channel 42. The insulating foam 100 is installed typically only where the beam mold 90 passes the C channel 42 within the wall mold 82. In addition the foam spacer 55 has a different tongue shape 55*a* and groove shape 55*b* configuration since the C channel 42 is used in FIG. 42. The foam spacer can be changed to fit any size or shape of support channels.

Figure 43:
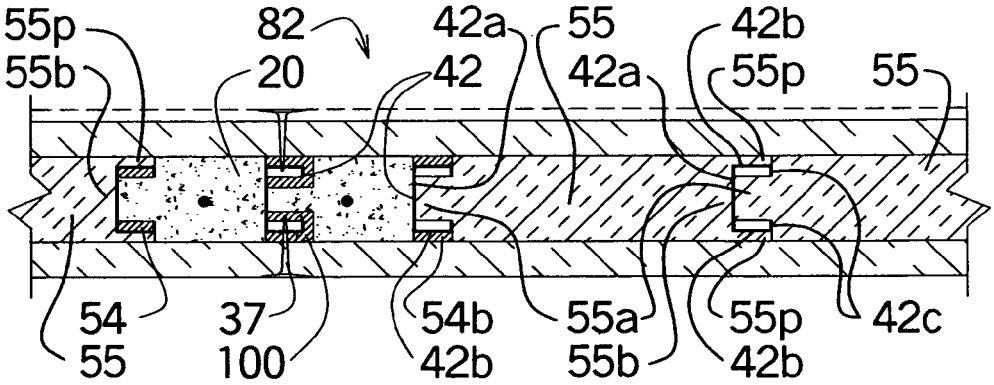
FIG. 43 shows a plan view of the C channel as the wall forming structure.

FIG. 43 shows a plan view of the wall mold 82 shown in FIG. 42. The insulation foam 100 is shown at the center C channel 42. The C channel 42 on the left side of the column mold 20 shows the foam spacer 55 over lapping the C channel 42 at the flange 42*b* at the groove shape 55*b* with a projection 55*p* extending the length of the flange 42*b*. A foam material 54 at the interior of the column mold 20 is connected at the flange 42*b* of the C channel 42. The left C channel 42 at the column mold 20 can be reversed as shown at the right C channel 42 of the column mold 20. The right C channel 42 of the column mold 20 is shown with foam material 54 at the flanges 42*b*. The foam material 54 can be incorporated as part of the foam spacer 55 as shown as the projection 55*p* of the groove shape 55*b*. The projection 55*p* and the groove shape 55*b* of the foam spacer 55 encases the outside face of the web 55*a* and the flanges 42*b* of the C channel 42 and the projection

55*p* extends to the lip 42*c*. The base plate 120 without the groves 121 shown in FIG. 41 or the angles 99 in FIG. 44 can be installed over the projections 55*p* of the foam spacers into any of the support channels previously shown, creating a thermal break between them.

Figure 44:
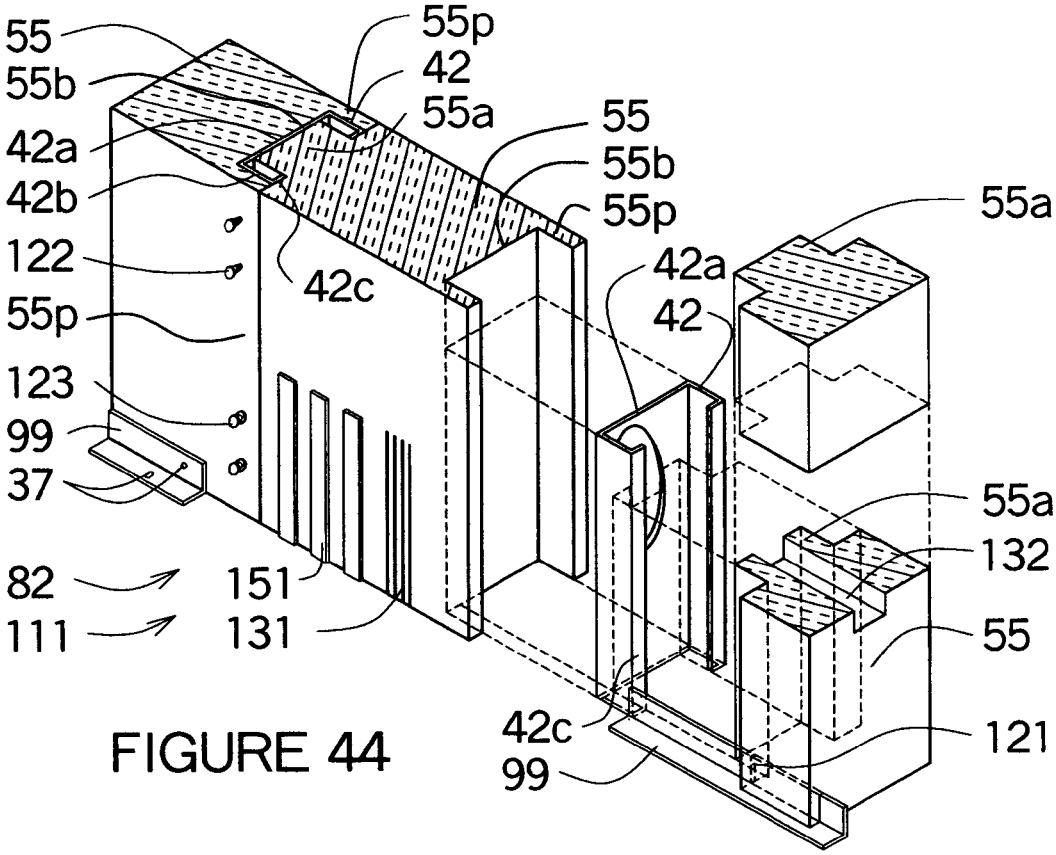
FIG. 44 shows the tongue and groove assembly at the structural insulating core.
Figure 46:
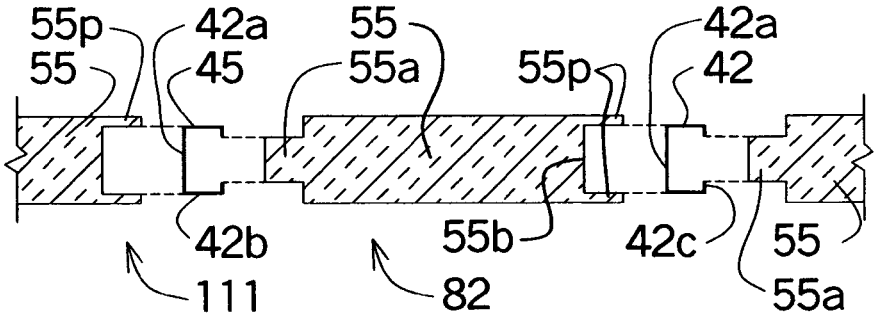
FIG. 46 show a plan view with the tongue and groove assembly using the C channel at the structural insulating core.
Figure 53:
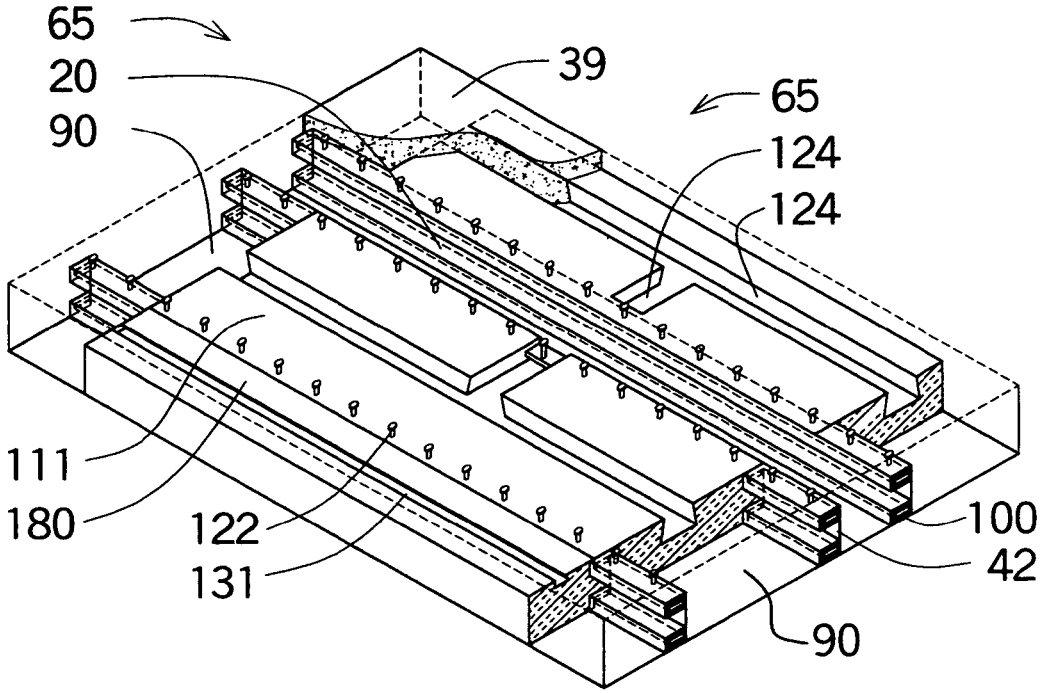
FIG. 53 shows a isometric view of precast wall mold when the concrete is poured over the structural insulating core.

FIG. 44 shows an isometric drawing of the structural insulating core 111 without the rigid board and rigid insulation as previous discussed in FIG. 42 consisting of two C channels 42 and three foam spacers 55 that are wider than the C channels 42. The foam spacer 55 between the C channels 42 abuts the web 42*a* at the tongue shape 55*a* of the foam spacer 55 and the foam spacer 55 abuts the lip 42*c* at the C channel 42 on the left. The opposite end of the foam spacer 55 has the groove shape 55*b* where the web 42*a* of the C channel 42 fits into. Since the foam spacers 55 are wider than the C channels 42 the excess foam spacer on both sides of the C channel 42 forms a projection 55*p* that overlaps both flanges 42*b*. The tongue and groove configuration shows how the foam spacers can easily fit together between the C channels 42. The projections 55*p* of the foam spacers 55 can easily be screwed or glued to the C channels 42. The webs 42*a* can easily be glued to the foam spacers 55 creating a stronger structural insulating core 111. FIG. 46 also shows the foam spacers 55 and C channels 42 in a separated position prior to securing the foam spacers 55 together creating a structural insulating core 111. The structural insulating core 111 can be used as an independent wall; an interior core for of the columns and beam molds previously described; and as a forming structure in a precast wall which is described in FIG. 53-56. A screw 122 and double headed fastener 123 are shown secured through the foam spacer 55 at the projection 55*p* or into the insulating foam 100 to connect precast concrete walls to the structural insulating core 111 shown in FIG. 53-56. A double headed screw was shown in LeBlang U.S. Pat. No. 6,041,561 to secure a precast concrete wall to metal channels. Not mentioned in the patent by LeBlang, is a screw 122 can be used to attach the insulating foam 100 to the C channel 42. Attaching the screw 122 and/or the double headed fastener 123 to the structural insulating core 111 provides as thermal break with the C channels 42 as well as providing a means of securing a structural insulating core 111 to concrete as shown in FIG. 53. When the structural insulating core 111 is installed within a wall mold 82 as shown in FIG. 42, and the rigid board 50 and rigid insulation 51 are all glued together, the wall mold 82 would then be considered a structural insulated panel (SIP). Usually a SIP has a rigid board 50 made of plywood on both sides of a foam core. By making the interior of a SIP with a structural insulating core 111, SIP's would be able to support a greater structural load for both a wall or a roof load since everything is glued together. Also shown are drainage channels 151 that protrude from the structural insulating core 111 to create a gap should it be required when some exterior surface finish materials (not shown) are applied over the structural insulating core 111. In addition a recessed groove 133 is shown on the exterior face of the structural insulating core 111 to allow water drainage between the structural insulating core 111 and various stucco applications. Since the structural insulating core 111 is a solid wall, two methods are shown to secure the structural insulating core 111 to a floor 175. Base plate angle 99 is shown attached to the C channel 42 at the flange 42*b* and the floor 175; however a groove 121 is cut into the structural insulating core 111 at the base plate angle 99. Another method is to install the base plate angle 99 on the surface of the structural insulating core 111 and connect to the flange 42*b* of the C channel 42 using a fastener 37 and thereby having a thermal break between the C channel 42 and the base plate angle 99. A trough 132 is shown in the middle of the structural insulating core 111 and is aligned with the holes 36 of the C channel 42 for use as an electrical chase within the structural insulating core 111. In some cases the trough 132 is required to be metal channel (not shown) for compliance with some electrical codes. In addition, the trough 132 can be used to install a horizontal bracing channel 150 shown in use in FIG. 47 connecting the C channels 42 within the structural insulating core 111.

Figure 45:
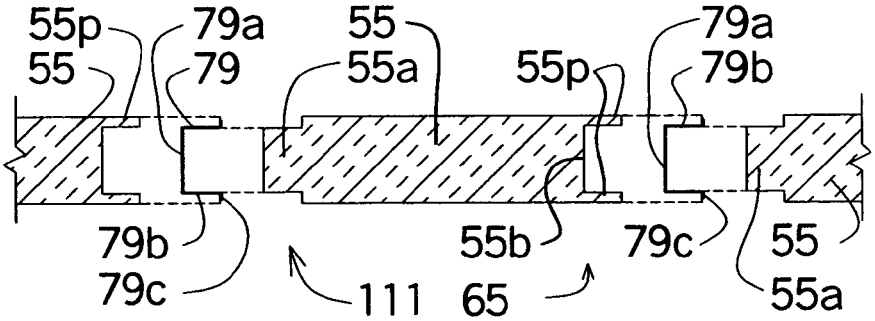
FIG. 45 shows a plan view with the tongue and groove assembly using the reverse lip channel at the structural insulating core.

FIG. 45 shows a plan view of FIG. 44 except here two reverse lip channels 79 are used between three foam spacers 55. The reverse lip channel 79 is similar to the C channel 42 in FIG. 7, except the lip 79*c* is bent in the opposite direction as the lip 42*c*. The tongue shape 55*a* a fits against the web 79*a* of the reverse lip channels 79 and the groove shape 55*b* fits against the adjacent reverse lip channel 79 at the web 79*a* and the projection 55*p* of the foam spacer 55 fits against the flanges 79*b* and abuts the lip 79*c*. Since the structural insulating core 111 has a snug fit between the reverse lip channels 79 and the foam spacers 55, the wall panel 65 can be glued together. The reverse lip channel 79 and the C channel 42 have the same physical characteristics since the lip 79*c* & 42*c* function in the same way giving the reverse lip channel 79 the same strength as the C channel 42.

Figure 47:
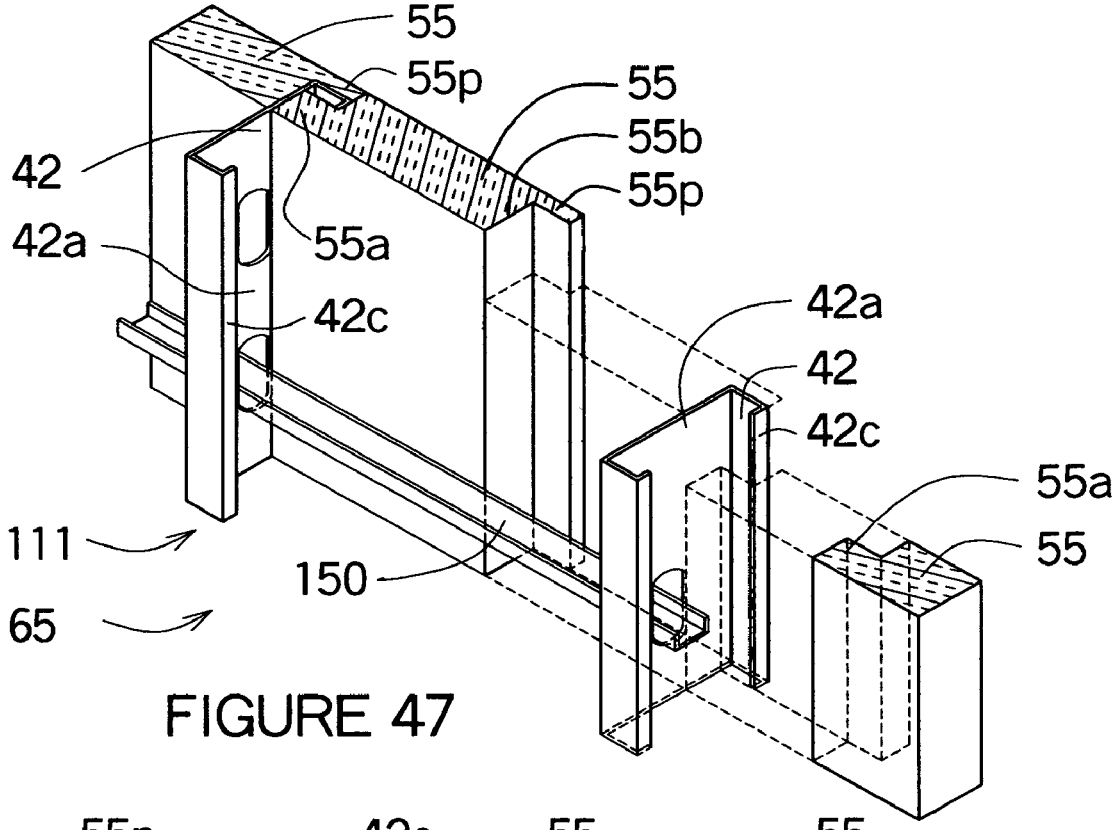
FIG. 47 shows an isometric view of a thinner tongue and groove foam spacer with a C channel wall structure.
Figure 48:
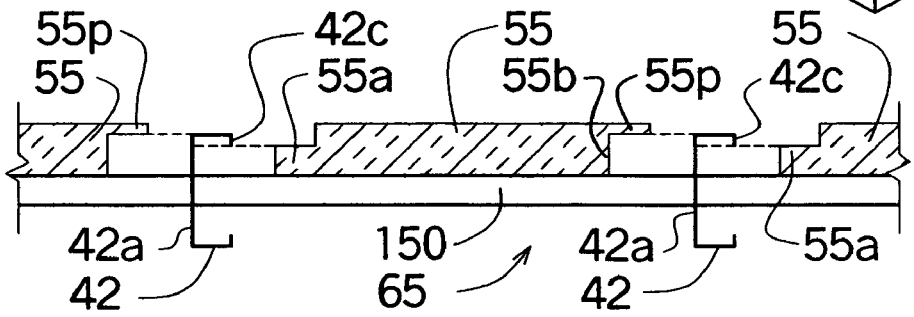
FIG. 48 is a plan view showing the thinner tongue and groove foam spacer using a C channel as the structure component of the wall.

FIG. 47 is similar to FIG. 44 except the three foam spacers 55 of the structural insulating core 111 is less than half the thickness of the foam spacers 55 in FIG. 44. The foam spacers 55 extends beyond the webs 42*a* of the adjoining C channels 42 enough to create a thermal break and cover the C channels 42 with the same projection 55*p*. The open portion of the C channel 42 has a lip 42*c* where the tongue shape 55*a* fits between and a horizontal bracing channel 150 (typically used to connect adjacent C channels within the building industry) plus the opposite end of the foam spacer 55 also fits between the webs 42*a* of the adjacent C channel 42. Since the foam spacer 55 overlaps the C channel 42 at the projection 55*p* and fits between the webs 42*a*, the foam spacer 55 is a wall insulation as well as a wall sheathing material all made together as one material. FIG. 48 is a plan view of the wall panel 65 showing the tongue shape 55*a* and groove shape 55*b* and the projection 55*p* of the foam spacer 55 between the C channels 42 as shown also in FIG. 47.

Figure 49:
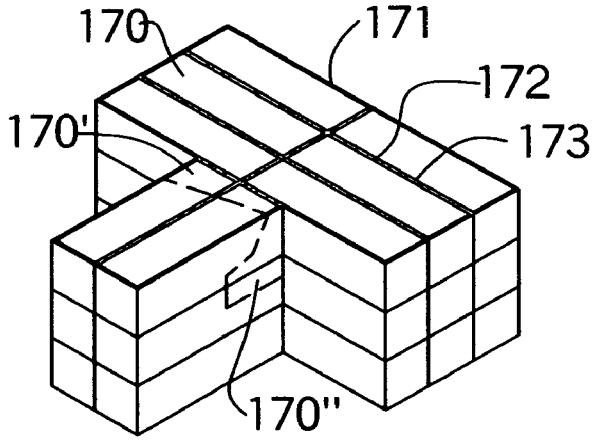
FIG. 49 is an isometric representation of modular building components stacked on top of each other and joined together to form a larger unit or building component.
Figure 50:
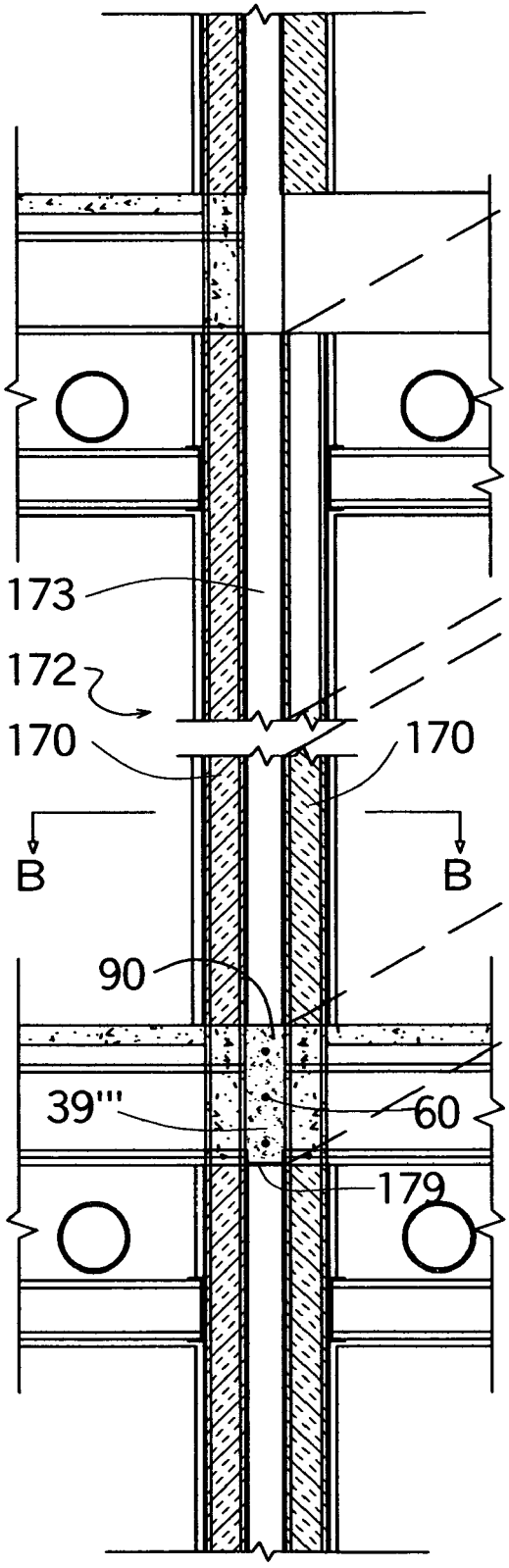
FIG. 50 is a representation of a modular wall section showing two adjacent modules installed adjacent to each other, the modules being illustrated separated with an air space between them. One of the modules is shown separated from the wall mold prior to being installed on the job site.
Figure 51:
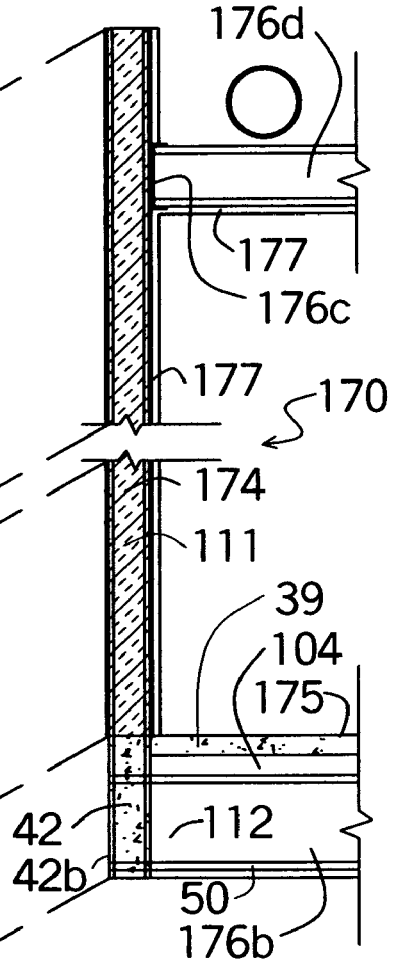
FIG. 51 is a diagrammatic representation showing the relationship of a single portion of one of the adjacent walls shown in FIG. 50.
Figure 52:
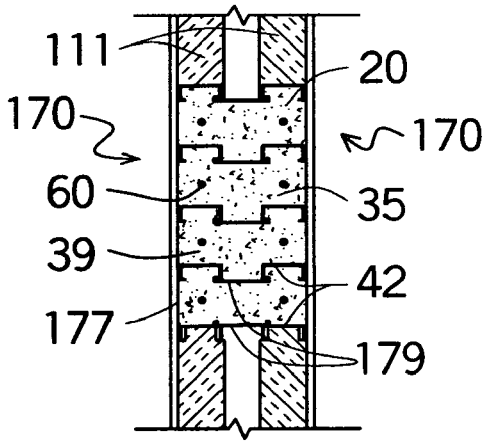
FIG. 52 is a plan section showing the mold formed by placing two modules adjacent to one another, but yet separated apart to form the mold for concrete to be installed to form a column; wall-forming ties being illustrated as installed between the one module and another module.

FIG. 49 shows an isometric view of various modular units 170 that are stacked on top of each other and adjacent to one another, but are joined together at the common walls 172 of each modular unit 170 where concrete columns and beams are formed within the common walls 172 of the various modular units 170 as a common wall mold 173 more clearly shown in FIGS. 50, 51 & 52.

The modules 170 are three-dimensional structures consisting of a wall 174, a floor 175 and a ceiling. The modules are built in a manufacturing plant, and finished on the interior, thereby leaving the structural system exposed on the exterior of the module where modules 170 abut one another. Other walls shown as exterior walls 171 of a module are finished with an exterior finished material directly from the manufacturing plant. Modules are shipped by truck and hoisted by crane to its specified location within the building. As one module is installed, additional horizontal or vertical steel reinforcement 60 is added between one module 170 and the other module 170 at the columns molds 20 and beam mold 90. As module 170 is installed adjacent to another module 170 form common wall molds 173 are created between modules, into which concrete 39 is poured to form a concrete column and beam within the common wall 172. Some modules might have exterior walls 171 that face the exterior of the module 170, which can be finished with a variety of building materials and built using various wall forming structures previously described, which when poured with concrete 39 become part of the module 170. The various column forming structures previously described can extend above, below or adjacent to another column or wall molds to become part of an adjacent module.

In FIG. 50, the modular wall section shows two adjacent modules 170 installed. The floor 175 is constructed using an array of metal floor joists 176*b* that extend into the structural insulating core 111 also shown in FIG. 51. Many different types or flooring systems construction are available on the market, however in the floor mold 112 shown in FIG. 50 is a patent pending by LeBlang US 2008/0062308 which consists of metal floor joists 176*b*, rigid board 50, form filler 104 insulation and concrete 39. Where the floor mold 112 connects to the structural insulating core 111 below the floor 175 are secured to the C channels 42 to the end of the floor joists 176*b*. Drywall 177 and a ceiling rim joist 176*c* are attached to the structural insulating core 111, concrete 39 then is poured over the floor mold 112 to the outer flange 42*b* of the C channel 42 thereby encasing the C channel 42 in concrete 39 to the level of the concrete floor 39'. The interior walls (not shown) are installed over the floor 175 and electrical, plumbing and heating are installed but not shown as a part of this FIG. 51. An array of ceiling joists 176*d* are installed with or without drywall 177 attached and secured to the ceiling joists 176*d*. A connector 179 is placed on the top of the adjoining structural insulating core's 111 connecting each module 170 together. A beam mold 90 is formed when the two adjacent modules 170 are installed together, the connector 179 are installed between the modules 170 and concrete 39 is installed between the structural insulating core 111 of each module. Instead of pouring concrete 39 on the floor mold 112, concrete 39 can be poured after the modules are set in place and the concrete 39 within the floor mold 112 will also flow into the beam mold 90.

FIG. 52 is a plan view showing the two adjacent modules 170 installed next to each other. The structural insulating core 111 is shown with the C channel 42 as well as additional C channels 42 shown at the column mold 20. A connector 179 connects the C channel 42 of the adjacent modules 170. Drywall 177 is shown as the interior finish of the modules 170. Additional reinforcing steel 60 is added into the column mold 20 and beam mold 90 between the adjacent modules 170. Concrete 39 is poured into the column mold 20 and then into the beam mold 90 connecting the modules 170 together.

Figure 54:
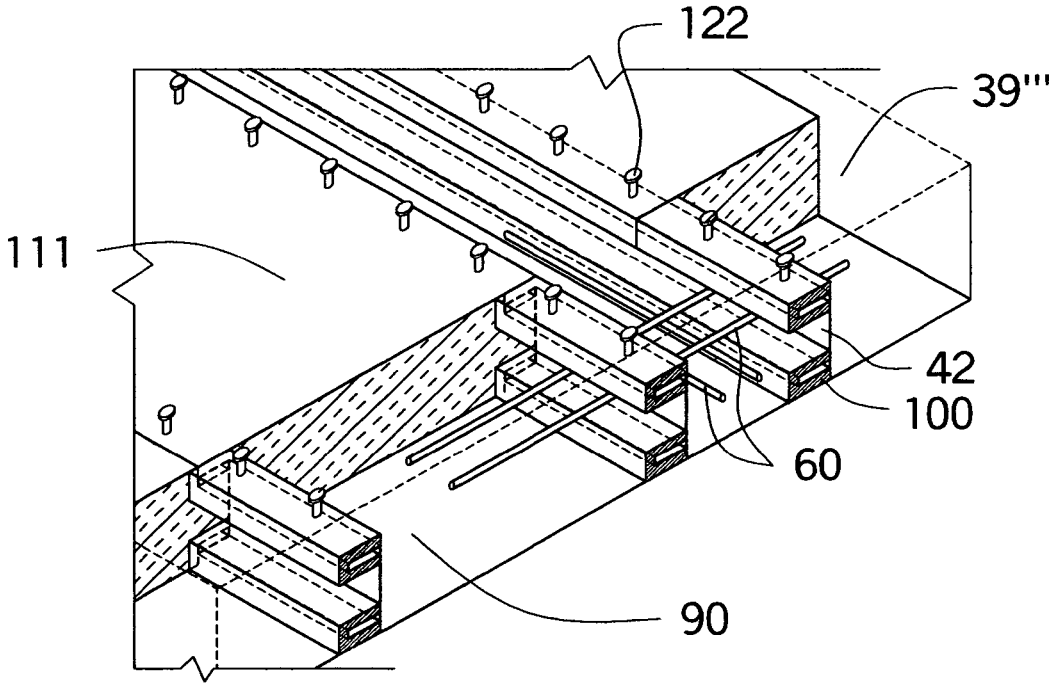
FIG. 54 shows and enlarged view of the column and beam in the precast wall when the concrete is poured face up.

FIG. 53 shows an isometric view of a wall panel 65 where the concrete 39 is poured on top of the structural insulating core 111 of the precast mold 180. Any of the previous described structural insulating cores 111 with either the spacer insulations, foam spacers 55 or supporting channel configurations can be used to form a precast mold 180. The previously described wall molds were first erected vertically then the hardenable material was poured into the wall molds, that is into the column and beam molds, while here the precast molds are layed horizontally and then the hardenable material is installed into the molds. The structural insulating core 111 shown here is similar to FIG. 42, however the rigid board 50 is not required and concrete 39 is used instead as the exterior wall material. The rigid insulation 51 shown in FIG. 42 can be used as the bottom of the precast mold 180 or a forming bed typical used in precast construction can be used. The C channels 42 of the structural insulating core 111 is shown extending into a beam mold 90 at the ends of the wall panel 65. The insulating foam 100 fits over the C channel 42 at the bottom of the beam mold 90 so drywall (not shown) or other materials can be attached after the concrete 39 has cured. Screws 122 or double headed fasteners (not shown) are attached through the structural insulating core 111 into the C channel 42. In addition a recessed groove 131 is installed to additionally secure the structural insulating core 111 to the concrete 39. Also to add additional strength to the wall panel 65 a rib 124 is installed parallel to the C channel 42 and another rib 124 is installed perpendicular to the C channel 42 in the structural insulating core 111. The ribs 124 add additional strength to the concrete 39 allowing the C channels 42 to be spaced further apart. The precast mold 180 is complete when the wall panel 65 side boards (not shown) are installed. Additional steel reinforcing (not shown) is installed in the beam molds 90 and the column mold 20 and concrete 39 is poured over and into the precast mold 180 when the precast mold 180 is in a horizontal position. Since the concrete 39 passes through the holes 36 (not shown) in the C channel 42 of the beam mold 90, the C channel 42 is secured to the structural insulating core 111. In addition, ribs 124 and grooves 121 are also installed on the structural insulating core 111 to add additional bonding strength to the concrete 39 bonding to the structural insulating core 111. When the ribs 124 and recessed grooves 131 are added to the structural insulating core 111, the screws that are secured to the C channel 42 might not be required to secure the concrete 39 to the structural insulating core 111. FIG. 54 is an enlarged view of the beam mold 90. Many of the other previously described wall molds can also be used to form the precast mold 180.

Figure 55:
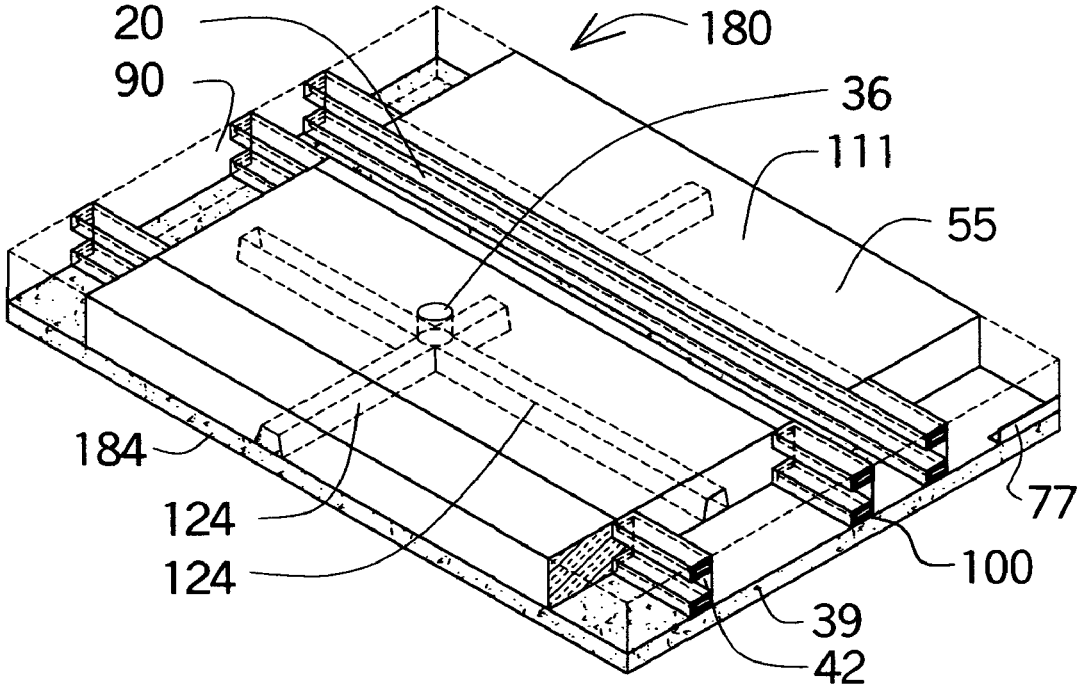
FIG. 55 shows an isometric view of a precast wall when the concrete is poured in a mold and the structural insulating core is placed over the concrete facing.

FIG. 55 is showing an isometric view of the same precast mold 180 as shown in FIG. 53 except the precast mold 180 is shown face down. The precast mold 180 is turned upside down so that the precast mold 180 is now placed onto a forming bed 184 and the structural insulating core 111 is suspended over the forming bed 184 so the flange 42*b* is set to the depth of the concrete 39 of the precast mold 180. Any of the previous described structural insulating cores 111 with either the spacer insulations, foam spacers 55 or supporting channel configurations can be used to form a precast mold 180. The previously described wall molds were first erected vertically then the hardenable material was poured into the wall molds, that is into the column and beam molds, while here the precast molds are layed horizontally and then the hardenable material is installed into the molds.

Figure 56:
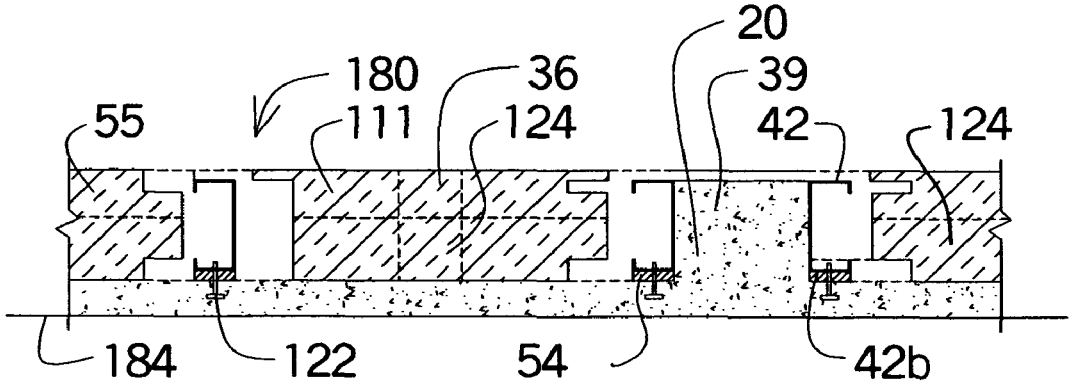
FIG. 56 shows a wall section of the precast wall when the concrete is poured face down in a mold.

In FIG. 56 the C channel 42 are shown having foam material 54 at the flange 42*b*. The foam material 54 is not really necessary since the C channel 42 is encased in concrete. Holes 36 are cut into the structural insulating core 111 at the criss-crossing ribs 124 to ensure concrete 39 flows into the ribs 124. Another way to form the precast mold 180 is to install the insulating foam 100 on each of the C channels 42 along with the screws 122 and install an angle 77 connecting each C channel 42 to the desire shape of the precast mold 180. Now set the precast mold 180 over the forming bed 184 and pour the concrete 39 into the forming bed 184, beam mold 90 and into the column mold 20. After the concrete has become firm, then add the remaining foam spacer 55 to complete the structural insulating core 111. The edge forming boards of the precast mold 180 are shown in (ghost).

Figure 57:
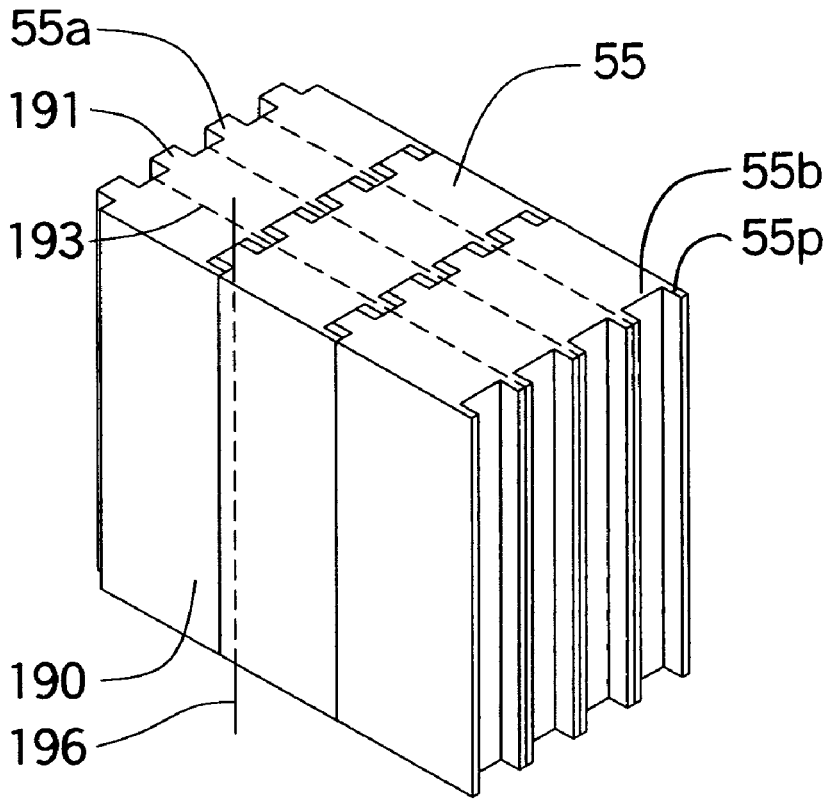
FIG. 57 is an isometric showing the mold and cutting process for the tongue and groove structural insulating core.

FIG. 57 shows an isometric drawing of a large foam block 190. The foam block 190 has a tongue mold 191 and a groove mold 192 on each side of the foam block 190. The previous drawings shown have many different types of channels within the various wall molds, wall panels as well as the various column and beam molds, therefore the foam spacer 55 and structural insulating cores 111 all have a different configuration at the channels. FIG. 57 shows the foam spacer 55 in FIGS. 44 & 46. The foam block is cut into smaller shapes by using a wire that when heated electric current in the hot wire cuts the foam material into many different shapes including foam spacers. By cutting the tongue shape 55*a* several foam spacers are being cut with the hot wire at the same time. The length of the foam blocks is cut at the groove shapes 55*b*, however the tongue shaped including the projections 55*p* is being cut at the same time. The process continues cutting the tongue and groove shapes until the foam block is fully cut. The foam block is now required to be turned 90 degrees so the foam block can be cut to the desire thickness of the spacer block and then rotated and turned 90 degrees to cut the height of the foam spacers. The foam spacer can also be cut to form and electric chase between blocks making the length cut to include the electric chase.

Figure 58:
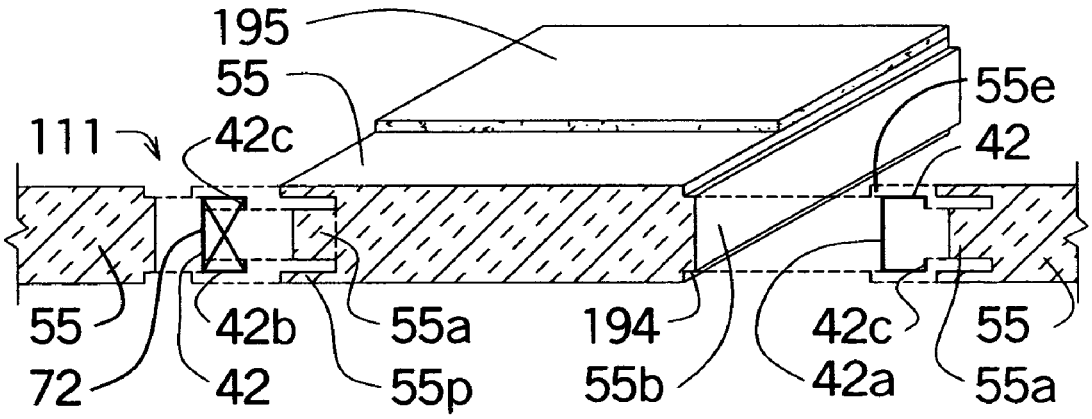
FIG. 58 is an oblique view of a different structural insulating core panel also shown with a thin cementitious coating.

FIG. 58 shows a plan view of a structural insulating core with an alternate shape for the foam spacer 55. The foam spacer 55 shows a protruding tongue 55*a* and a projection 55*p* on the same side of the foam spacer 55. The tongue shape 55*a* is the same as in FIG. 44 where the tongue shape 55*a* fits between the 42*c* of the C channels 42 and abuts the web 42*a* when installed in place. In FIG. 58 the projection 55*p* extends past the web 42*a* and is longer than the flange 42*b* of the C channel 42. The additional length of the projection 55*p* is shown as an extension 55*e* of the foam spacer 55 is the equal to the length of the flange 42*b* plus the length of the recess 194 where the foam spacer 55 abuts is longer than the flange 42*b* of the C channel 42 thereby overlapping the adjacent foam spacer 55. What is shown in FIG. 58 is that the foam spacer 55 can be cut into any configuration and still be installed next to an adjacent C channel 42 using the same configured foam spacer 55. On the other hand, when the C channel 42 is wood blocking 72 (as shown by an X), the tongue shape no longer extends to the web 42*a* but abuts the wood blocking 72 and the projection 55*p* still rests in the recess 194 of the groove shape 55*b* of the adjacent foam spacer 55. In addition, a cementitious coating 195 can be installed on any of the foam spacers 55 prior to being installed in the C channels 42.

CONCLUSION AND SCOPE OF INVENTION

A new method of construct a concrete post and beam structure using the wall forming structure plus the interior and exterior rigid board and the spacer insulation or just the foam spacer configurations as the mold to form concrete columns and beams in or protruding from a wall. The concrete columns and beams are made using the light gauge metal building components or plastic composites as the forming structure within the wall mold. The rigid board or rigid insulation for the wall surfaces and spacer insulation supports the beam within the wall.

To form a concrete column within a framed wall, the channels are spaced the length of the column width to support the concrete. If the column is required to be too long, additional channels are installed to connect the exterior and interior sheathing on both sides of the flanges of the channels. The column width is determined by the width of the web of the channel. The larger the column size required the wider of the wall and the larger the channel size within the wall.

The wall forming structures within the wall molds are not structural supports to support additional floors or to support a beam, but are used to attach the exterior and interior rigid boards to the wall forming structure in order to form a column or beam mold. Concrete columns and beams are poured when the wall are erected in a vertical position as a single wall or as a modular building as well as in a horizontal position as a precast wall. The drawings have shown many wall forming structures like an elongated column or "L" shaped columns.

Different types of wall forming supports are shown. Some wall supports make the spacer channels easier to insert into an adjoining wall support and others all for foam material to surround the flange of the wall supports. Others had an air space at the interior of the support channel to allow for fasteners to penetrate the forming supports to later connect drywall or an exterior building material. The foam material at the forming support flanges give the thermal break as well as a water stop (should the wall be installed below grade) between the forming supports and the exterior or interior wall surface.

The tongue and groove interlocking of the foam spacer allows a wall to be formed easier and is a better method to stop heat or cold transfer through a wall. The interlocking foam spacer can be used as a typical exterior wall with or without the concrete column or beam within the wall. The interlocking foam spacer can used with any of the support channels plus can be connecting vertically between panels. The foam spacer can easily be slide into place without having to measure between channels for a faster and easier connection.

The foam insulation can be used as a insulator between the precast concrete and the metal supports. The fasteners can be connected either through the spacer insulation or the foam spacer on the outer surface of the support structure. The support channels with the fastener through the foam spacer can be installed so the fastener is embedded into the concrete bed (like a typical precaster).

Another method would be to have the wall built with the support channels and spacer channels, then install the fasteners through the foam spacer and pour the concrete over the wall foam spacer forming a precast wall.

The structural insulating core can be used as an independent wall, screwed or glued to together to form a SIP or together to form a larger SIP to form concrete columns and beams.

It is understood that the invention is not to be limited to the exact details of operation or structures shown and describing in the specification and drawings, since obvious modifications and equivalents will be readily apparent to those skilled in the art. The flexibility of the described invention is very versatile and can be used in many different types of building applications.

The invention claimed is:

1. A wall mold for forming a building comprising:

a structural insulating core having an array of support channels extending the full height of the structural insulating core, rigid foam strips positioned against opposing support channel flange faces, wherein the foam strips provide a space into which a fastener extending through the channel flange may project;

spacer insulation blocks installed between adjacent support channels of the structural insulating core, the spacer insulation block depth equal to the width of a web of the support channels, the blocks fully extending from a lower beam mold formed at the bottom region of the core to the opposite, top region of the core that forms an upper beam;

inner and outer rigid boards attached to flanges located on both sides of the support channels, the boards fully extending between the support channels and longitudinally extending from the bottom of the supports channels to a height below the top of the support channels such that a beam mold is created in a void formed between the top of the wall mold and another wall panel or roof structure located above the wall mold, the boards forming the inner and outer major faces of the wall mold, the spacer insulation blocks positioned between the inner and outer rigid boards, and wherein the inner and outer rigid insulation boards of the upper and lower structural insulating core define the inner and outer major faces of the beam molds;

a column mold formed in a void located between adjacent spacer insulation blocks, the void including the support channels, the support channel webs having openings for hardenable material to flow through, wherein the support channel is encompassed by the hardenable material, and the inner and outer rigid boards defining the inner and outer faces of the column mold;

the structural insulating core oriented vertically and steel reinforcing installed in the beam and column molds, the steel reinforcing installed in the beam mold passing through the support channel openings, and wherein the structural insulating core is configured to allow hardenable material to be poured thus forming the column and beam molds, the structural insulating core forming the wall mold.

2. The wall mold of claim 1 further comprising an "H"-shaped support channels.

3. The wall mold of claim 2 further comprising a "C"-shaped support channels.

4. The wall mold of claim 2 further comprising the support channels embedded in the building footing.

5. The wall mold of claim 1 further comprising the foam spacers between the support channels having a width wider than the support channels and having a groove and transverse mating tongue extend along the transverse length of facing, opposed side projection surfaces with the groove and tongue surfaces contacting the encompassing support channel.

* * * * *